US006817202B1

(12) United States Patent
Anthony

(10) Patent No.: US 6,817,202 B1
(45) Date of Patent: Nov. 16, 2004

(54) AEROSOL PROPELLED SCENT GENERATING SELF-COOLING BEVERAGE CONTAINER WITH PHASE LOCKED PROPELLANT MIXTURES AND PROCESS OF MANUFACTURING THE SAME

(76) Inventor: Michael M. Anthony, 10189 W. Sample Rd., Coral Springs, FL (US) 33065

( * ) Notice: Subject to any disclaimer, the term of this patent is extended or adjusted under 35 U.S.C. 154(b) by 0 days.

(21) Appl. No.: 10/628,099

(22) Filed: Jul. 28, 2003

(51) Int. Cl.[7] ..... F25D 27/00
(52) U.S. Cl. ..... 62/293; 62/371
(58) Field of Search ..... 62/293, 371, 457.3, 62/457.4

(56) References Cited

U.S. PATENT DOCUMENTS 5,131,239 A * 7/1992 Wilson ..... 62/293
5,941,078 A * 8/1999 Scudder et al. ..... 62/4
6,581,401 B1 6/2003 Anthony

* cited by examiner

*Primary Examiner*—William E. Tapolcai
(74) *Attorney, Agent, or Firm*—Oltman, Flynn & Kubler

(57) ABSTRACT

A self cooling container with an internal receptacle. The receptacle responds to differences in pressure between its internal and external walls so that when pressure acting external to the receptacle walls falls to atmospheric pressure the receptacle releases cooling agents that cool the contents of the container. The cooling agent may be scented with a pleasing scent. The container may be a can or a bottle for example. A method is provided for producing the bottle by blow molding of a plastic preform with threaded necks at opposite ends thereof and first and second chambers communicating with the necks with the second chamber inside the first chamber.

5 Claims, 28 Drawing Sheets

AEROSOL PROPELLED SCENT GENERATING SELF-COOLING BEVERAGE CONTAINER WITH PHASE LOCKED PROPELLANT MIXTURES AND PROCESS OF MANUFACTURING THE SAME

BACKGROUND OF THE INVENTION

1. Field of the Invention

The present invention relates generally to the field of food and beverage containers and to processes for manufacturing such containers with aerosol propellant mixtures and scents of various kinds. More specifically the present invention relates to a scent generating self-cooling beverage container apparatus containing a beverage or other food product, a method of propelling a scent by means of an aerosol propellant mixture, which then cools said food products, and to methods of assembling and operating the apparatus. The terms "beverage," "food," "food products" and "container contents" are considered as equivalent for the purposes of this application and used interchangeably.

2. Description of the Prior Art

There have previously been self-cooling containers for cooling the contents such as food or beverages that include flexible and deformable receptacles with widely spaced apart, rigid receptacle walls, and methods of manufacturing these containers. These prior art do not address the real issues of manufacturing and beverage plant operations that are crucial for the success of a self-cooling beverage container program. All prior art designs fail when subjected to the immense pressures (about 45–60 psi) of the carbonated filling process and fail to maintain the container column strength The sudden blast of carbon/dioxide inside a container during filling, can destroy any thin-walled internal container, and collapse its walls so that the functionality of the apparatus will be impaired. Also, the sudden collapse of such internal containers, can cause the can itself to loose column strength, and collapse under the clamping force that is applied for sealing the can during filling. Many trials and designs were done to obtain the present configuration of the disclosed receptacle of this invention. No prior art teaches bow to manufacture a self-cooling beverage plastic bottle as a single unified unit that will conform to the standards of the beverage industry.

For example when an internal receptacle is used as a pressurized gas storage receptacle, the beverage filler head pressurizes its external walls and crushes the receptacle, since such receptacles are generally made from thin walled materials for rapid heat transfer, they can be easily crushed by external pressure and cannot survive the forces of the high speed manufacturing process. Thus, failure of the internal receptacle, can also result in the sudden collapse of the container walls. Even with prior designs of co-seamed internal receptacles such as that described in U.S. Pat. No. 6,065,300 to the present inventor the problem was still not solved. Also, the high speed beverage plants require high speed compatible operations for manufacture of an online self-cooling beverage container. For example, prior art designs do not address easy insertion, self-aligning of the receptacle with the container and so on. Further, most prior art relies on a separate unintegrated manufacturing process for the attachment of the receptacle to the container. The prior art differs from the current disclosed invention in that they all require complicated valving for activation of the cooling process. Most use rubber seals, gaskets and expensive attachment means. The present invention does not require a special valving system. Just two parts that form the receptacle and the attachment means to the can suffice to form a self acting valve based on the opening of the container for consumption. U.S. Pat. No. 6,581,401,B1 invented by the present inventor shows a technology based on phase locked refrigerants that are only used to cool a beverage container such as a can or bottle. This invention is an improvement over said patent and discloses a novel technology for bottles also with the additional aspect of using aerosol propellant mixtures that will propel a scent from the container. The reason for the improvement is that no other technology addresses the repugnant smells generated by various gas mixtures, and further this invention calls for the use of aerosol propellant mixtures specially formulated with a scent such as a coca-cola scent, fruity smells or the smell of fresh flowers for example.

SUMMARY OF THE INVENTION

The present invention accomplishes the above-stated objectives, as well as others, as may be determined by a fair reading and interpretation of the entire specification.

For the preferred of several possible embodiments, the apparatus includes a conventional beverage or food container such as a metal or plastic container for containing a product to be consumed. For metal containers, the container has a conventional unified domed bottom wall, and a cylindrical side container wall terminating in an upper container sealing rim. A container sealing lid is also provided for sealing off the container contents inside the container. A hole passes through the center of the domed bottom wall of the container making fluid communication between the inside and the outside of the container. The apparatus further comprises a thin walled plastic or metal receptacle with substantially the shape of a small plastic or metal bottle with a bottle neck. With the said receptacle oriented so that it sits on a bottom wall rim and with the open bottle neck facing an upwardly direction, the receptacle comprises a substantially horizontal round top wall with an upward facing surface and a downward facing surface. From the center of the upward facing surface is joined a short smaller diameter cylindrical receptacle neck protrusion which terminates with a thin receptacle open neck round flange. Said receptacle open neck flange having a slightly larger diameter than the cylindrical receptacle neck. The receptacle top wall has a diameter that is greater than the diameter of the receptacle open neck protrusion. The top wall and the receptacle neck form a continuous unified wall of the receptacle with the receptacle open neck also passing through the receptacle top wall as an entry way for ingredients that are to be stored inside the receptacle. A receptacle side wall sealingly joins the receptacle top wall protruding in the downward direction to sealingly join a substantially round receptacle bottom wall. Thus, the receptacle walls are all joined together to form continuous bottle with an open neck. The receptacle bottom wall is designed to be slightly flexible and to flex up and down the axis of the receptacle, so as to increase the overall length of the receptacle when the pressure acting inside the receptacle walls is greater than the pressure acting outside the receptacle walls. In general the walls of the receptacle are flexible and thin relative to its size. The receptacle is designed to be handled easily for manufacturing the self-cooling container so that the processes that would be encountered during the manufacturing would be easily accomplished because of the way the receptacle is designed and works. The receptacle is designed to store a liquified aerosol propellants or a matrix held aerosol propellants and smell ingredients such as a combination of $CO_2$ and carbon atoms, at a minimal pressure difference across its walls by means of equilibration with beverage pressure, and when the aerosol propellant pressure acting inside the receptacle walls equilibrates with beverage pressure acting outside the receptacle walls. The preferred aerosol propellant is a mixture of hydrocarbons and flame retarding chemicals such as 134*a* and FM 200 or other flame retarders that may be appropriate. The aerosol propellants may be designed as a slurry of an activated carbon matrix with CO2 gas trapped inside the matrix. The receptacle sealed bottom wall is flexible. A substantially conical valve seat protrusion protrudes outwardly in a downward direction from the center of the receptacle bottom wall. The inside wall of the valve seat recess is designed to sealingly mate with the scaling cone of a substantially tubular stem valve, so that liquified aerosol propellant and scent chemicals contained inside the receptacle will not boil and escape from within the receptacle when the pressure outside the receptacle is greater than the pressure of the aerosol propellant gas contained inside the receptacle. Advantageously, the receptacle valve seat recess will not form a seal with the stem valve sealing cone if the outside pressure acting on the receptacle walls is less than the liquified aerosol propellant pressure acting on inside walls of the receptacle.

The apparatus further comprises a stem valve for mating with the receptacle. The stem valve is a substantially tubular valve with a sealing cup flange attached near one end of the stem valve. The sealing cup flange is shaped like a shallow bowl of a diameter of approximately 1 inch and a depth of about ¼ inch, for sealing against the bottom wall of the beverage container. A short cylindrical tube of a length of about ½ inches and diameter ⅜ inch protrudes from the outer surface of the sealing cup flange and connects to a conical tube stem valve body of a length of about 3 inches. The dimensions given are only for the sake of comparative clarity of the present invention, and should not be construed as the only possible dimensions for the parts of the apparatus. A short small cylindrical stud protrudes from the inside surface of the sealing cup flange in the opposite direction to the stem valve body. The approximate diameter of the stud is about ¼ inch, but it could be larger or smaller depending on the size of the beverage container the apparatus is designed for. A small stem valve hole passes through the entire length of the stem valve. The stem valve hole could be made larger inside the stem valve body, for reasons of ease of manufacturing. However, the hole that passes through the stud must be close to 0.04 inches diameter. Again all of the dimensions sited are examples of one embodiment of the invention. The stem valve conical protrusion is designed to tightly push to form a swage fitting, or to snap into the hole through the domed bottom wall of the beverage container holding the receptacle and stem valve assembly centrally inside the beverage container. The sealing cup flange forms a tight gas seal against the domed bottom wall of the beverage container when the stem valve stud is tightly affixed into the container bottom wall hole.

In one embodiment of the invention, the apparatus is assembled by first affixing the stem valve into the receptacle by passing the stem valve body through the receptacle open neck, so that the receptacle stem valve cylindrical body seals against the receptacle neck cylinder, and the outside surface of the stem valve sealing cup flange sealingly mates to the surface of the receptacle open neck flange. The stem valve cylinder is designed to fit snugly and tightly into the receptacle open neck so that a gas tight plug is formed around the receptacle open neck protrusion. The stem valve is made long enough so that when the stem valve sealing cup flange mates with the receptacle open neck flange, the stem valve sealing cone also sealingly abuts the inside side wall of the receptacle valve seat recess. Thus, when the stem valve sealing cone abuts the inside side wall of the receptacle valve seat recess, pressurized gas cannot escape through the stem valve hole, or through the receptacle open neck protrusion, when the pressure inside the receptacle is less than the pressure outside the receptacle. And when the pressure inside the receptacle is greater than the pressure outside the receptacle the receptacle valve seat recess is expanded and moves away from the stem valve sealing cone so that pressurized gas can escape through the stem valve hole. Other methods of practicing the invention do not require that the stem valve bottom edge seal the inside wall of the receptacle valve seat recess when the stem valve flange is fully seated on the receptacle open neck flange. It is important that the stem valve sealing cone be close to or actually contact the inside surface of the receptacle valve seat, so that if the pressure inside the receptacle is less than the pressure outside the receptacle, the receptacle bottom wall is deflected inwardly to make contact between the inner surface of the receptacle valve seat recess and the sealing cone of the stem valve to form a gas tight seal that traps any liquified or gaseous aerosol propellant inside the receptacle from escaping to the outside through the stem valve hole.

To manufacture the apparatus, the receptacle is first filled with clean water. The stem valves are then inserted into the receptacle through the receptacle open neck to displace some water and form a seal with the receptacle open neck and the receptacle valve seat recess inside surface. Thus the water is trapped inside the receptacle and cannot pass through the stem valve hole, or the receptacle open neck. The assembly is then inserted into the beverage container, and the stem valve stud is aligned and pushed through the container bottom wall hole. The stem valve stud is made slightly larger in diameter than the diameter of the container bottom wall hole, so that as the stem valve stud pushes through the container bottom wall hole, the stem valve stud forces the container bottom wall hole rim to form a slightly conical depression around the rim forming a thin wall of conical material protruding out of the container. This conical ring of material forms a fight swage fitting that holds the stud firmly in place on the container and so does not allow the assembly to be easily removed from the hole. A snap action may also be used for this attachment. The deforming of the hole into a substantially conical rimed hole, causes the container wall material to bight into the softer valve stud material and form a hematic seal, and a very tight strangle hold on the valve stud. The stem valve is pushed into the container bottom hole until the stem valve sealing cup flange makes a tight cup seal between the stem valve and the container bottom wall. The assembly is then transported to a beverage filling plant, where the apparatus is filled with beverage product under carbonation pressure.

During the beverage filling process, a filler head is sealed against the beverage container rim. Nitrogen or carbonation pressure is transmitted from the beverage filler head to the inside space of the beverage container. This pressure is also fully transmitted to the receptacle outer walls. The pressure within the receptacle builds up and equilibrates with the pressure of gas inside the beverage container. The pressure outside the receptacle causes the receptacle bottom wall to deform slightly, pushing against the trapped water in the receptacle until the receptacle valve seat recess inside wall seals tightly against the sealing cone of the stem valve. This stops any water from escaping from the receptacle. Since the receptacle is now filled with only water, and water is essentially incompressible, minimal deformation of the receptacle walls occurs preventing any damage to the thin receptacle walls. The pressurization of the container with carbon-dioxide gas is important when carbonated beverage are being filled to ensure that the carbonation of the beverage occurs during the filling process. The beverage itself is usually carbonated when it enters the container, where, because of the absorption of pressurized carbon-dioxide gas, it becomes highly carbonated. For a container without the receptacle, the container column strength is obtained by the filler head firmly forming a seal with the empty open container rim and pressurizing the container directly with a blast of carbon-dioxide gas. The column strength of the container is obtained by the internal pressure of the container. This allows the filler head to firmly seal the rim of the container to maintain the pressure of the beverage during the filling process. Thus it is important that the above steps be taken in manufacturing a useful self-cooling beverage container. Absence of water could cause the receptacle walls to collapse and prevent column strength from building up, thus causing the container to collapse under the filler head forces. Thus, during filling, the receptacle advantageously transmits the filler head forces directly to the water without subjecting the container walls or the receptacle walls to deformation stresses.

The method of manufacture of the receptacle generally involves the broad steps of injection molding preforms from suitable plastic materials; blow molding the receptacle to a shape of particular form; orienting the receptacle for filling with water; inserting the stem valve into the receptacle; and insertion the assembly into beverage containers so that the stem valve stud is pushed ti a tight fit into the container bottoms wall hole; filling the beverage container with beverage; seaming the container lid onto the container rims; checking for carbonation column strength of the filled and seamed container. The steps further comprise; the broad steps of ejecting the water in the receptacle by pressure feeding a small dose of higher liquified aerosol propellants into the receptacle through the stem valve hole; said aerosol propellant opening the seal made between the valve seat recess and the sealing cone of the stem valve body; using a high pressure piston charger to charge liquified aerosol propellants through the stem valve hole into the receptacle; storing the apparatus for later sale or use by a consumer.

It is important to know that the liquified phase of the aerosol propellants or gas/carbon matrix to be used for cooling must be at a lower pressure than the beverage carbonation pressure. This is a requirement of the invention, since the beverage pressure must be able to overcome the internal pressure of the aerosol propellants inside the receptacle, to force the receptacle valve seat recess to form a seal with the stem valve outer bottom edge. This is because as the pressure in the beverage container builds up, it compresses the receptacle walls and forces the larger surface area of the receptacle bottom wall inward into receptacle toward the stem valve bottom edge. However, since the area exposed to the aerosol propellant pressure inside the valve seat recess is smaller than the outer surface area exposed to beverage carbonation pressure by the amount of the area trapped by the receptacle valve seat recess and the stem valve outer bottom edge, and since the carbonation pressure is higher than the beverage pressure, the valve seat and stem valve sealing cone will seal off the stem valve hole from the aerosol propellants completely. If careful calculations are made, it is possible to have the aerosol propellant pressure equal or greater than the carbonation pressure by adjusting the area of exposed valve seat sealed off area. This makes it possible to use other suitable refrigerants. The difference in pressure can be estimated by the following formula:

$$P_R \leq \frac{(P_B - P_S)D^2}{(D^2 - d^2)}$$

where $P_R$ is the maximum pressure of the aerosol propellants to be used, $P_B$ is the pressure of the carbonated beverage, and $P_s$ is the security difference in pressure to be used for the sealing of the aerosol propellants during storage, and D is the diameter of the bottom receptacle wall, and d is the diameter of the sealing cone of the stem valve. $P_s$ is nominally found to be about 5 psi under normal temperature conditions in Florida. In other countries, the value of $P_s$ will depend on the variability of the carbonation pressure and the aerosol propellant pressure with ambient conditions, particularly, temperature.

Thus by adjusting any of these parameters, the aerosol propellant pressure could be determined for any given stem valve and receptacle dimensions and given beverage pressure. This offers a great variability in the possible types of gases that could be used for cooling the beverage, and a variety of embodiments could be used.

Since by design the carbonation pressure will always form a seal for the aerosol propellant gas in the receptacle, the removal of the trapped water in the receptacle is a little demanding. This is achieved by using a higher pressure liquid dose aerosol propellants other than the aerosol propellants to be stored in the receptacle. This small liquid dose of aerosol propellants must always produce a force that tends to open the valve seal. This can be achieved if the pressure of the liquid dose aerosol propellants $P_D$ follows the relation, $$P_D > \frac{(P_B + P_S)D^2}{(D^2 - d^2)}.$$

For example if the carbonation pressure $P_B$=50 psi, and if D=1.86, d=0.25, with a safety pressure lock of $P_s$=5 psi, the aerosol propellants pressure must be given by, $$P_R \leq \frac{(50-5)1.86^2}{(1.86^2 - .25^2)} = 45.83 \text{ psi}$$

and the liquid dose aerosol propellant pressure required to evacuate the water from the receptacle must be greater than the value calculated by the formula, $$P_D > \frac{(50+5)1.86^2}{(1.86^2 - .25^2)} = 56.01 \text{ psi}$$

however, the surface area of the stem valve hole is far smaller than the area of the receptacle bottom wall, so that the pressure required be exerted through the stem valve hole to push back the receptacle valve seat away from the stem valve sealing cone is far greater than that of the liquified aerosol propellants alone. A higher pressure aerosol propellant may be used to achieved this. It is preferable that the aerosol propellant used to practice the invention have a lower vapor pressure in the liquefied state than the beverage carbonation pressure. This allows the receptacle bottom wall to always force the receptacle valve seat back into a sealing position against the sealing cone of the stem valve. Thus, if water is to be displaced from the receptacle, a liquid dose aerosol propellant with a liquid phase pressure higher than carbonation pressure may be used but not stored in the receptacle. With the liquid dose aerosol propellant pressure higher than the carbonation pressure, the liquid dose aerosol propellant is able to maintain the stem valve and the receptacle valve seat in a relatively open state until all the water and liquid dose aerosol propellant has escaped from the receptacle. Some liquid dose aerosol propellant in a gaseous form will remain in the receptacle to keep the receptacle walls from collapsing under carbonation pressure. Upon complete or almost complete removal of the water from the receptacle, the liquified aerosol propellant charge or mixture that is to be stored in the receptacle is then injected through the stem valve hole into the receptacle by a pressure assist piston pump in a liquified state into the receptacle. This has the advantage of completely filling the receptacle with liquified aerosol propellant without deforming the receptacle walls. Alternatively if a carbon matrix is used to store some aerosol propellant, then the carbon matrix is first poured into the receptacle prior to inserting the stem valve. Upon completion of the charging, carbonation pressure pushes against the receptacle bottom wall to reseal the receptacle bottom wall conical protrusion against the stem valve outer bottom edge, trapping the liquified aerosol propellant inside the receptacle.

The completed apparatus is then stored or shipped to a customer for consumption. The process of activation involves simply opening the container lid for consumption, so that the carbonation pressure falls to atmospheric pressure, and the pressure of the liquified aerosol propellant acting on the internal walls of the receptacle becomes greater than atmospheric pressure, causing the receptacle bottom wall to push away from the stem valve outer bottom edge, and breaking the seal. Since the stem valve sealing cone is above the liquid level of the aerosol propellant, only gas is releases through the bottom of the container, when the container is upright. This also has the advantage of preventing anyone from playing with the apparatus until it is opened for consumption.

To operate the present invention for use as a self-cooling container, no additional activation means is provided that can be tampered with by a user. The beverage container opening means is opened for the container contents to be consumed. This simultaneously opens the receptacle valve and aerosol propellant mixture is progressively discharged from the receptacle, extracting heat from the container contents by means of evaporation.

A self-cooling container apparatus is further provided for retaining container contents such as food or beverages; and a container contents release mechanism for releasing the container contents from the container and also for effectuating the release of liquified gas stored in the receptacle.

A process of manufacturing the above-described self-cooling container apparatus is provided, including the steps of orienting the stem valves for insertion into the receptacles; filling the receptacles with water, inserting the stem valves into the receptacles; and inserting the assemblies into beverage containers; filling each beverage container with beverage; pumping a high pressure liquified aerosol propellant into the receptacle to exhaust the water from the receptacle; filling the receptacle with aerosol propellant; seaming or crimping the container lid onto the container.

For plastic bottle containers, the receptacle is integrated with the beverage bottle by a novel blow molding technic which involves the use of a dual preform that is blown in two stages. The plastic preform is designed as two concentric cylinders that are unified at the neck of the inner cylinder and the bottom of the outer cylinder of the preform. The inner part of the preform is a cylindrical vessel with a threaded open neck that is oriented with its bottom sealing wall inside the outer cylindrical part of the preform. The outer cylinder has a threaded open neck, so that the two cylindrical vessels are oriented with their open threaded necks in opposite directions. Thus, a concentric beverage chamber is formed between the walls of the projecting inner part of the preform and the outer part of the preform. The inner part of the preform is also designed with a conical valve seat as its base. Thus, the valve seat described earlier for the metal container receptacle is formed when the preform is made. The first stage of manufacturing the container is to heat and blow the outer part of the preform through the open threaded neck while maintaining a support member inside the inner part of the preform valve seat, so that the shape of the valve seat is maintained. Another support member is inserted through the open neck of the formed bottle to support the outer surface of the valve seat, so that the valve seat is trapped between the inner support member and the outer support members during molding. The valve seat of the inner cylinder of the preform is thus left intact when the bottle is formed, and when the aerosol propellant receptacle is formed by the second blowing. The mold for the outer preform is designed to take the shape of any plastic beverage container, so that when the bottle is formed, it looks like a functional plastic beverage bottle. Thus, when the outer part of the preform is blown, a conventional bottle is formed with a receptacle projecting within it. The beverage bottle thus formed now has a projecting cylinder inside it with a threaded neck protruding from its bottom wall. The second stage of manufacture, is to heat and insert a blow pin and support member through the threaded neck of the inner cylinder part and then blowing the preform inside the bottle while supporting the valve seat of the inner part of the preform. This will cause the inner preform to substantially expand and form a paraboloid aerosol propellant receptacle that can be used to store a aerosol propellant mixture. Thus, advantageously, a beverage bottle is formed by the outer part of the preform which has a conventional unified bottom wall that is fused to the inner aerosol propellant receptacle with a threaded neck protruding from the bottom and top walls respectively. A threaded plastic cap is also provided for sealing off the beverage bottle contents. Now, the internal protruding aerosol propellant receptacle formed by the blown inner part of the preform forms a paraboloid aerosol propellant receptacle since the pressure generated by blowing will essentially impart a paraboloid shape to the cylindrical inner part of the preform. The bottle form by the larger outer cylinder of the preform has a shape that is governed by the mold that forms it. The inner aerosol propellant receptacle thus formed comprises a parabolic aerosol propellant receptacle terminating at a conical bottom valve seat. The aerosol propellant receptacle is designed to store a liquified aerosol propellant mixture at a minimal pressure difference across its walls by means of equilibration with beverage pressure of the of the outer beverage bottle when the aerosol propellant pressure acting inside the aerosol propellant receptacle walls equilibrates with beverage pressure acting outside the receptacle walls. The aerosol propellant may be designed as mixture of aerosols and scents or as a slurry of activated carbon matrix with CO2 gas trapped inside the slurry matrix. The aerosol propellant receptacle valve seat is flexible. The inside wall of the valve seat recess is designed to sealingly mate with the scaling cone of a substantially tubular part of a stem valve, so that liquified aerosol propellant contained inside the receptacle will not boil and escape from within the aerosol propellant receptacle when the pressure outside the aerosol propellant receptacle is greater than the pressure of the aerosol propellant gas contained inside the receptacle. Advantageously, the aerosol propellant receptacle valve seat will not form a seal with the stem valve sealing cone if the outside pressure acting on the receptacle walls is less than the liquified aerosol propellant pressure acting on inside walls of the aerosol propellant receptacle.

The apparatus further comprises a stem valve for mating with the aerosol propellant receptacle. The stem valve is a substantially tubular valve with a sealing threaded cap attached near one end of the stem valve. The aerosol propellant sealing threaded cap is made to sealing attach to the threaded neck of the aerosol propellant receptacle and at the same time it forms a base cup seat for the bottle. A short cylindrical tube of a length of about ½ inches and diameter ⅜ inch protrudes from the outer surface of the aerosol propellant sealing threaded cap and connects to a conical tube stem valve body of a length of about 3 inches. The dimensions given are only for the sake of comparative clarity of the present invention, and should not be construed as the only possible dimensions for the parts of the apparatus. A short small cylindrical stud protrudes from the inside surface of the aerosol propellant sealing threaded cap in the opposite direction to the stem valve body. The approximate diameter of the stud is about ¼ inch, but it could be larger or smaller depending on the size of the beverage bottle the apparatus is designed for. A small stem valve hole passes through the entire length of the stem valve. The stern valve hole could be made larger inside the stem valve body, for reasons of ease of manufacturing. However, the hole that passes through the stud must be close to 0.04 inches diameter. Again all of the dimensions sited are examples of one embodiment of the invention.

In one embodiment of the invention, the apparatus is assembled by first affixing the stem valve into the aerosol propellant receptacle by passing the stem valve body through the aerosol propellant receptacle threaded open neck, so that the aerosol propellant receptacle sealing threaded cap threads into the projecting threaded aerosol propellant receptacle neck cylinder. The stem valve cylinder is designed to fit snugly and tightly into the aerosol propellant receptacle open neck so that a gas tight plug is formed around the aerosol propellant receptacle sealing threaded open neck protrusion. The stem valve is made long enough so that when the stem valve sealing threaded cap mates with the aerosol propellant receptacle threaded open neck, the stem valve sealing cone also sealingly abuts the inside side wall of the aerosol propellant receptacle valve scat recess. Thus, when the stem valve sealing cone abuts the inside side wall of the aerosol propellant receptacle valve seat recess, pressurized gas cannot escape through the stem valve hole, or through the aerosol propellant receptacle open neck protrusion, when the pressure inside the aerosol propellant receptacle is less than the pressure outside the aerosol propellant receptacle. And when the pressure inside the aerosol propellant receptacle is greater than the pressure outside the aerosol propellant receptacle the aerosol propellant receptacle valve seat recess is expanded and moves away from the stem valve sealing cone so that pressurized gas can escape through the stem valve hole. An sealing cone is provided on the stem valve to ensure proper sealing with the valve seat. Other methods of practicing the invention do not require that the stem valve bottom edge seal the inside wall of the aerosol propellant receptacle valve seat recess when the stem valve threaded cap is fully sealingly threaded unto the aerosol propellant receptacle threaded open neck. It is important that the stem valve sealing cone be close to or actually contact the inside surface of the aerosol propellant receptacle valve seat, so that if the pressure inside the aerosol propellant receptacle is less than the pressure outside the aerosol propellant receptacle, the aerosol propellant receptacle bottom wall is deflected inwardly to make contact between the inner surface of the aerosol propellant receptacle valve seat recess and the sealing cone of the stem valve to form a gas tight seal that traps any liquified or gaseous aerosol propellant inside the aerosol propellant receptacle from escaping to the outside through the stem valve hole.

To manufacture the apparatus, the aerosol propellant receptacle is first filled with clean water. The stem valves are then inserted into the aerosol propellant receptacle through the aerosol propellant receptacle open threaded neck to displace some water and form a seal with the aerosol propellant receptacle open threaded neck and the aerosol propellant receptacle valve seat recess inside surface. Thus the water is trapped inside the aerosol propellant receptacle and cannot pass through the stem valve hole, or the aerosol propellant receptacle open threaded neck. The assembly is then transported to a beverage filling plant, where the bottle is filled with beverage product under carbonation pressure.

During the beverage filling process, a filler head is sealed against the beverage bottle threaded neck rim. Nitrogen or carbonation pressure is transmitted from the beverage filler head to the inside space of the bottle. This pressure is also fully transmitted to the aerosol propellant receptacle outer walls. The pressure within the aerosol propellant receptacle builds up and equilibrates with the pressure of gas inside the bottle. The pressure outside the aerosol propellant receptacle causes the aerosol propellant receptacle bottom wall to deform slightly, pushing against the trapped water in the aerosol propellant receptacle until the aerosol propellant receptacle valve seat recess inside wall seals tightly against the sealing cone of the stem valve. This stops any water from escaping from the aerosol propellant receptacle. Since the aerosol propellant receptacle is now filled with only water, and water is essentially incompressible, minimal deformation of the aerosol propellant receptacle walls occurs preventing any damage to the thin aerosol propellant receptacle walls. The pressurization of the bottle with carbon-dioxide gas is important when carbonated beverage are being filled to ensure that the carbonation of the beverage occurs during the filling process. The beverage itself is usually carbonated when it enters the bottle, where, because of the absorption of pressurized carbon-dioxide gas, it becomes highly carbonated. For a bottle without the aerosol propellant receptacle, the bottle column strength is obtained by the filler head firmly forming a seal with the empty open bottle rim and pressurizing the bottle directly with a blast of carbon-dioxide gas. Absence of water could cause the aerosol propellant receptacle walls to collapse and the aerosol propellant receptacle to collapse and damage under the filler head forces. Thus, during filling, the aerosol propellant receptacle advantageously transmits the filler head forces directly to the water without subjecting the aerosol propellant receptacle walls to deformation stresses.

The method of manufacture of the aerosol propellant receptacle generally involves the broad steps of injection molding preforms as describe above from suitable plastic materials; blow molding the aerosol propellant receptacle in two stages or in a single stage to form the bottle and aerosol propellant receptacle; orienting the bottle for filling the aerosol propellant receptacle with water, inserting the stem valve into the aerosol propellant receptacle and locking the stem valve threaded cap unto the aerosol propellant receptacle threaded neck; filling the bottle with beverage; and capping the bottle with a threaded cap; checking for carbonation column strength of the filled bottle. The steps further comprise; the broad steps of ejecting the water in the aerosol propellant receptacle by pressure feeding a small dose of higher liquified aerosol propellant into the aerosol propellant receptacle through the stem valve hole, said aerosol propellant opening the seal made between the valve seat recess and the sealing cone of the stem valve body, using a high pressure piston charger to charge liquified aerosol propellant through the stem valve hole into the aerosol propellant receptacle; storing the apparatus for later sale or use by a consumer.

It is important to know that the liquified phase of the aerosol propellant or the aerosol propellant/carbon matrix to be used for propelling the scent and cooling the beverage must be at a lower pressure than the beverage carbonation pressure. This is a requirement of the invention, since the beverage pressure must be able to overcome the internal pressure of the aerosol propellant inside the aerosol propellant receptacle, to force the aerosol propellant receptacle valve seat recess to form a seal with the stem valve outer bottom edge. This is because as the pressure in the bottle builds up, it compresses the aerosol propellant receptacle walls and forces the larger surface area of the aerosol propellant receptacle bottom wall inward into aerosol propellant receptacle toward the stem valve bottom edge. However, since the area exposed to the aerosol propellant pressure inside the valve seat recess is smaller than the outer surface area exposed to beverage carbonation pressure by the amount of the area trapped by the aerosol propellant receptacle valve seat recess and the stem valve outer bottom edge, and since the carbonation pressure is higher than the beverage pressure, the valve seat and stem valve sealing cone will seal off the stem valve hole from the aerosol propellant completely. If careful calculations are made, it is possible to have the aerosol propellant pressure equal or greater than the carbonation pressure by adjusting the area of exposed valve seat sealed off area. This makes it possible to use other suitable aerosol propellant s. The difference in pressure can be estimated by the following formula:

$$P_R \leq \frac{(P_B - P_S)D^2}{(D^2 - d^2)}$$

where $P_R$ is the maximum pressure of the aerosol propellant to be used, $P_B$ is the pressure of the carbonated beverage, and $P_s$ is the security difference in pressure to be used for the sealing of the aerosol propellant during storage, and D is the diameter of the bottom aerosol propellant receptacle wall, and d is the diameter of the sealing cone of the stem valve. $P_s$ is nominally found to be about 5 psi under normal temperature conditions in Florida. In other countries, the value of $P_s$ will depend on the variability of the carbonation pressure and the aerosol propellant pressure with ambient conditions, particularly, temperature.

Thus by adjusting any of these parameters, the aerosol propellant and scent chemicals pressure could be determined for any given stem valve and aerosol propellant receptacle dimensions and given beverage pressure. This offers a great variability in the possible types of gases that could be used for cooling the beverage, and a variety of embodiments could be used.

Since by design the carbonation pressure will always form a seal for the aerosol propellant gas in the aerosol propellant receptacle, the removal of the trapped water in the aerosol propellant receptacle is a little demanding. This is achieved by using a higher pressure liquid dose aerosol propellant other than the aerosol propellant to be stored in the aerosol propellant receptacle. This small liquid dose of aerosol propellant must always produce a force that tends to open the valve seal. This can be achieved if the pressure of the liquid dose aerosol propellant $P_D$. follows the relation, $$P_D > \frac{(P_B + P_S)D^2}{(D^2 - d^2)}.$$

For example if the carbonation pressure $P_B$=50 psi, and if D=1.86, d=0.25, with a safety pressure lock of $P_s$=5 psi, the aerosol propellant pressure must be given by, $$P_R \leq \frac{(50 - 5)1.86^2}{(1.86^2 - .25^2)} = 45.83 \text{ psi}$$

and the liquid dose aerosol propellant pressure required to evacuate the water from the aerosol propellant receptacle must be greater than the value calculated by the formula, $$P_D > \frac{(50 + 5)1.86^2}{(1.86^2 - .25^2)} = 56.01 \text{ psi}$$

however, the surface area of the stem valve hole is far smaller than the area of the aerosol propellant receptacle bottom wall, so that the pressure required be exerted through the stem valve hole to push back the aerosol propellant receptacle valve seat away from the stem valve bottom outer edge is far greater than that of the liquified aerosol propellant alone. A higher pressure aerosol propellant may be used to achieved this. It is preferable that the aerosol propellant used to practice the invention have a lower vapor pressure in the liquified state than the beverage carbonation pressure. This allows the aerosol propellant receptacle bottom wall to always force the aerosol propellant receptacle valve seat back into a sealing position against the sealing cone of the stem valve. Thus, if water is to be displaced from the aerosol propellant receptacle, a liquid dose aerosol propellant with a liquid phase pressure higher than carbonation pressure may be used but not stored in the aerosol propellant receptacle. With the liquid dose aerosol propellant pressure higher than the carbonation pressure, the liquid dose aerosol propellant is able to maintain the stem valve and the aerosol propellant receptacle valve seat in a relatively open state until all the water and liquid dose aerosol propellant has escaped from the aerosol propellant receptacle. Some liquid dose aerosol propellant in a gaseous form will remain in the aerosol propellant receptacle to keep the aerosol propellant receptacle walls from collapsing under carbonation pressure. Upon complete or almost complete removal of the water from the aerosol propellant receptacle, the liquified aerosol propellant charge or mixture that is to be stored in the aerosol propellant receptacle is then injected through the stem valve hole into the aerosol propellant receptacle by a pressure assist piston pump in a liquified state into the aerosol propellant receptacle. This has the advantage of completely filling the aerosol propellant receptacle with liquified aerosol propellant and smell generating ingredients without deforming the aerosol propellant receptacle walls. Alternatively if a carbon matrix is used to store some aerosol propellant, then the carbon matrix is first poured into the aerosol propellant receptacle prior to inserting the stem valve. Upon completion of the charging, carbonation pressure pushes against the aerosol propellant receptacle bottom wall to reseal the aerosol propellant receptacle bottom wall conical protrusion against the stem valve outer bottom edge, trapping the liquified aerosol propellant inside the aerosol propellant receptacle.

The completed apparatus is then stored or shipped to a customer for consumption. The process of activation involves simply opening the beverage bottle cap for consumption, so that the carbonation pressure falls to atmospheric pressure, and the pressure of the liquified aerosol propellant acting on the internal walls of the aerosol propellant receptacle becomes greater than atmospheric pressure, causing the aerosol propellant receptacle bottom wall to push away from the stem valve outer bottom edge, and breaking the seal. Since the stem valve sealing cone is above the liquid level of the aerosol propellant, only gas is releases through the bottom of the container, when the container is upright. This also has the advantage of preventing anyone from playing with the apparatus until it is opened for consumption.

To operate the present invention for use as a scented self-cooling container, no additional activation means is provided that can be tampered with by a user. The beverage container opening means is opened for the container contents to be consumed. This simultaneously opens the aerosol propellant receptacle valve and aerosol propellant mixture is progressively discharged from the aerosol propellant receptacle, extracting heat from the container contents by means of evaporation.

A self-cooling apparatus is further provided for retaining contents such as food or beverages; and contents release mechanism for releasing the contents from the bottle and also for effectuating the release of liquified aerosol propellant gas stored in the aerosol propellant receptacle.

A process of manufacturing the above-described scented self-cooling container apparatus is provided, including the steps of orienting the stem valves for insertion into the aerosol propellant receptacles; filling the aerosol propellant receptacles with water, inserting the stem valves into the aerosol propellant receptacles; and inserting the assemblies into beverage containers; filling each beverage container with beverage; pumping a high pressure liquified aerosol propellant into the aerosol propellant receptacle to exhaust the water from the aerosol propellant receptacle; filling the aerosol propellant receptacle with aerosol propellant; seaming or crimping the container lid onto the container.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
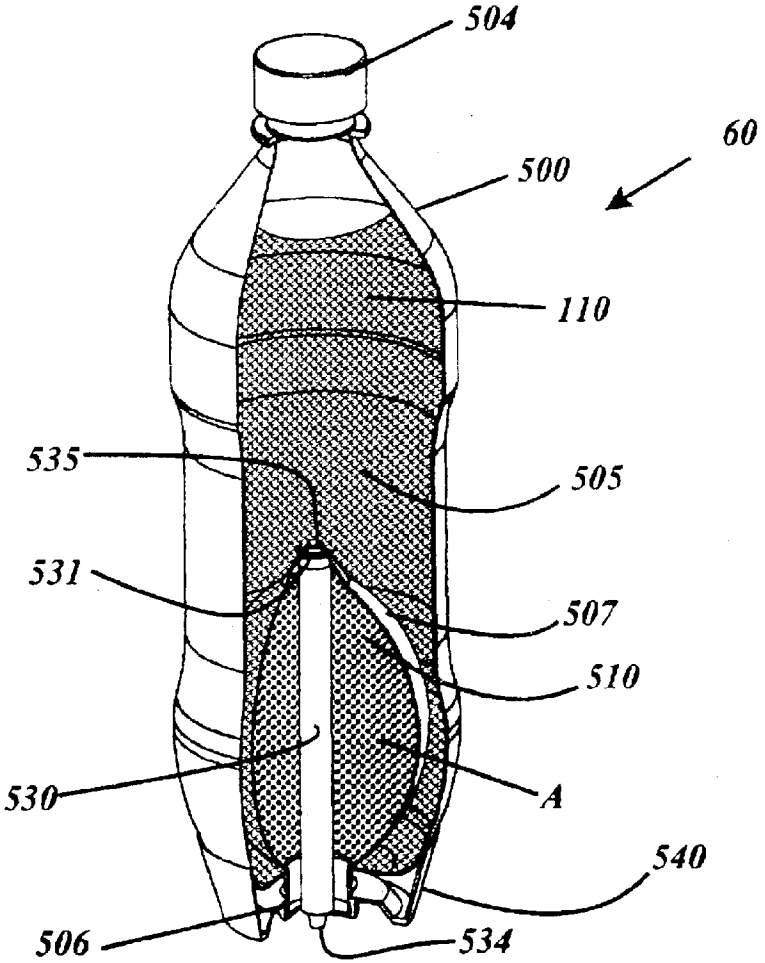
FIG. 2 shows the embodiment for a second version for plastic bottles.
Figure 1:
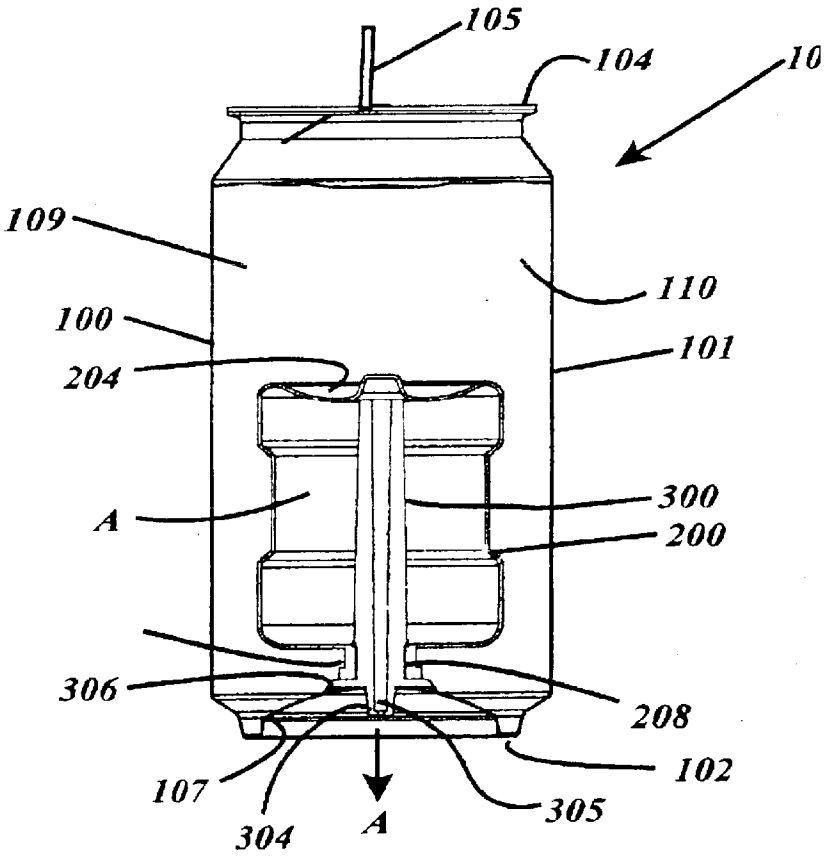
FIG. 1 shows the first embodiment of the apparatus for a metal beverage container.
Figure 3:
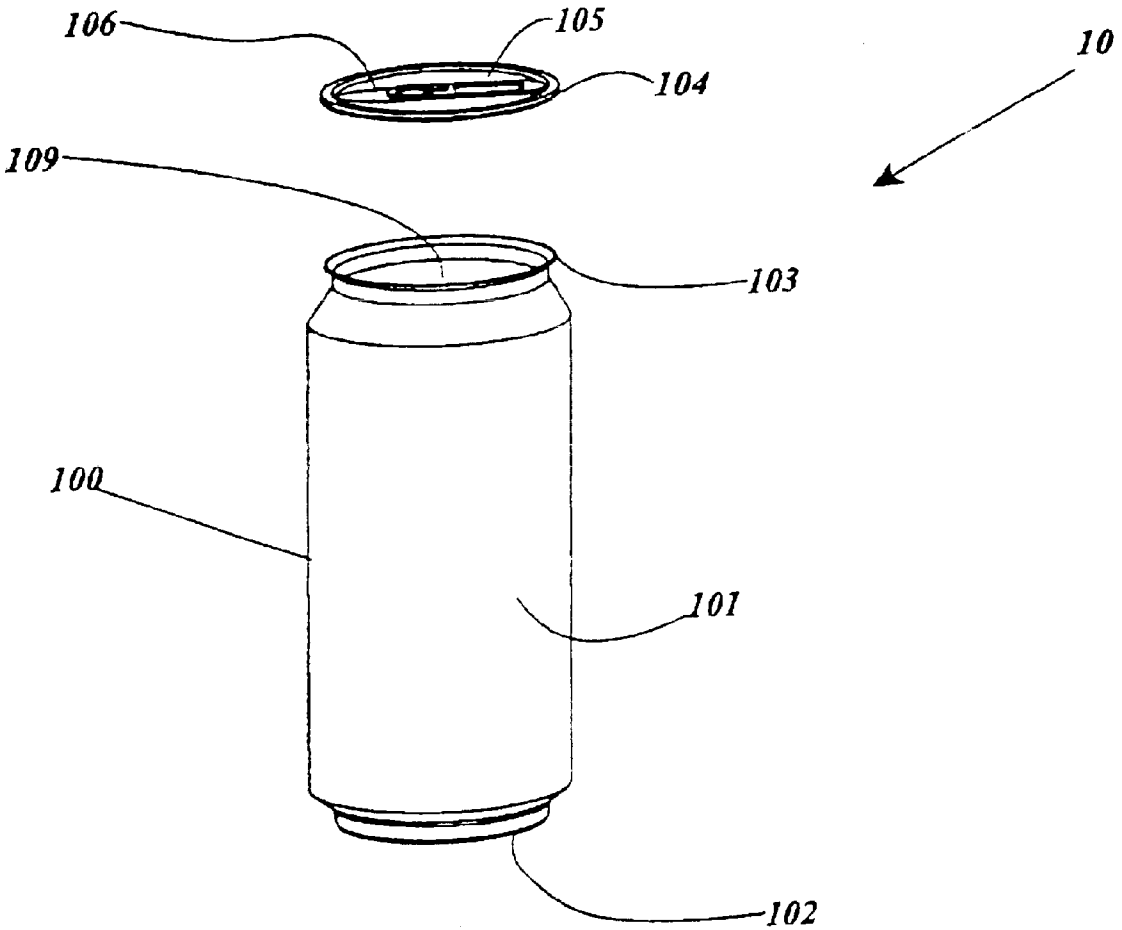
FIG. 3 shows the lid of the beverage container with an open beverage container.
Figure 4:
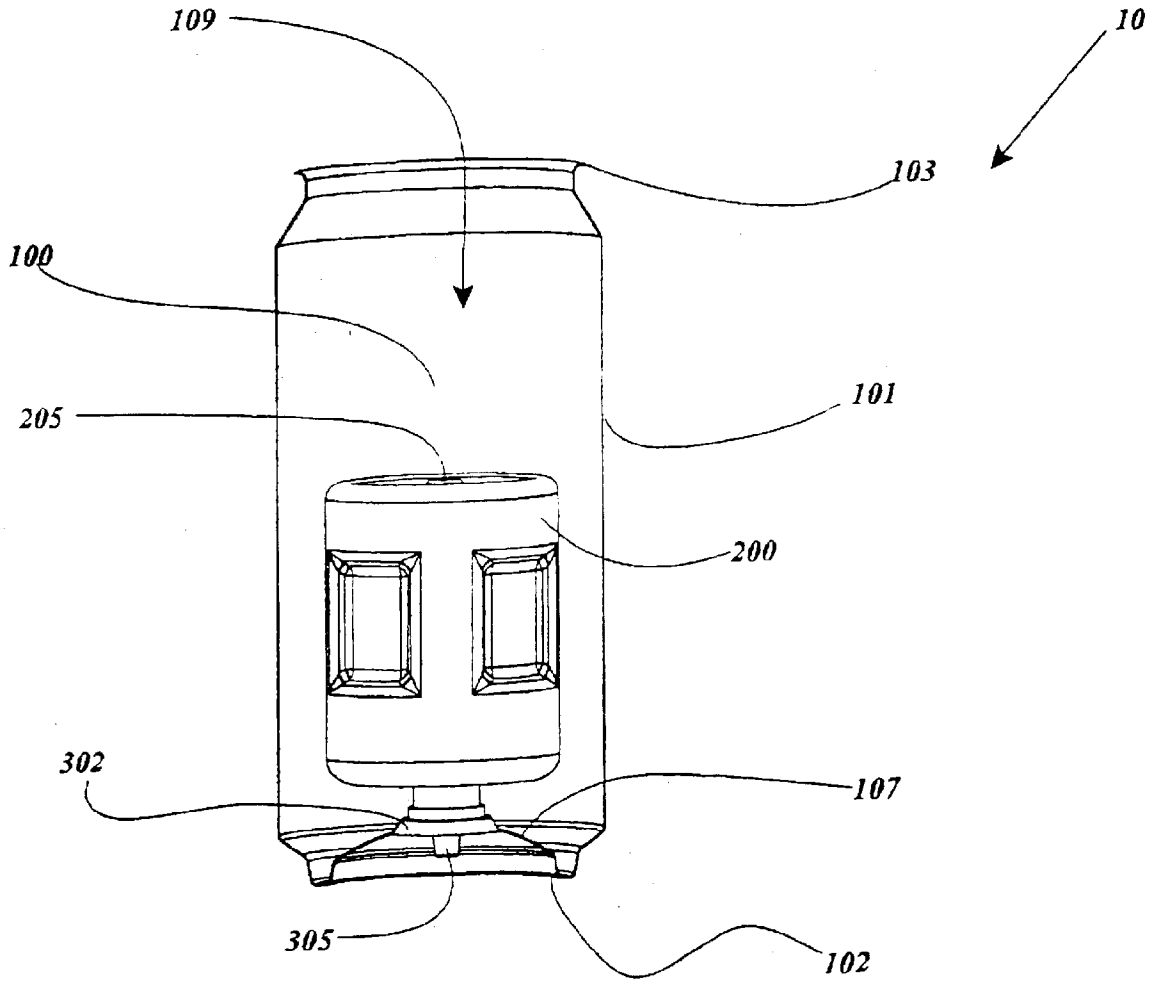
FIG. 4 shows the apparatus assembled with the aerosol propellant receptacle and the stem valve in potion.
Figure 5:
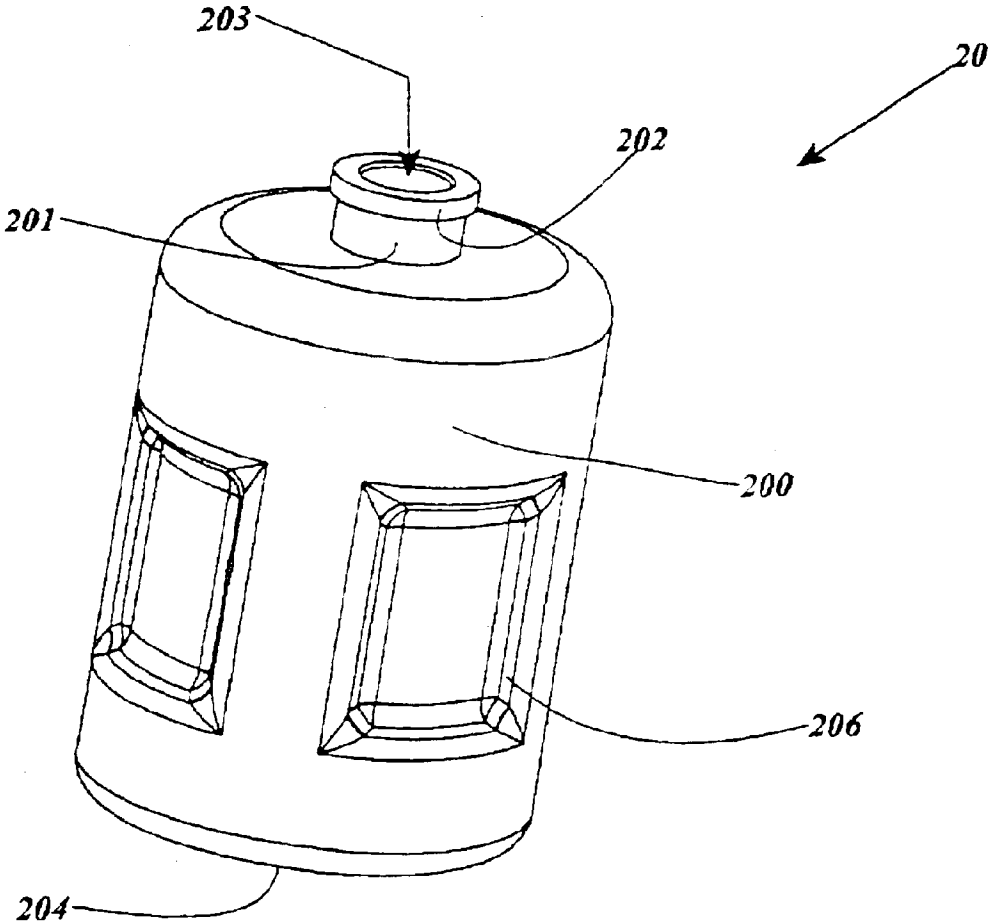
FIG. 5 shows one embodiment of the aerosol propellant receptacle.
Figure 6:
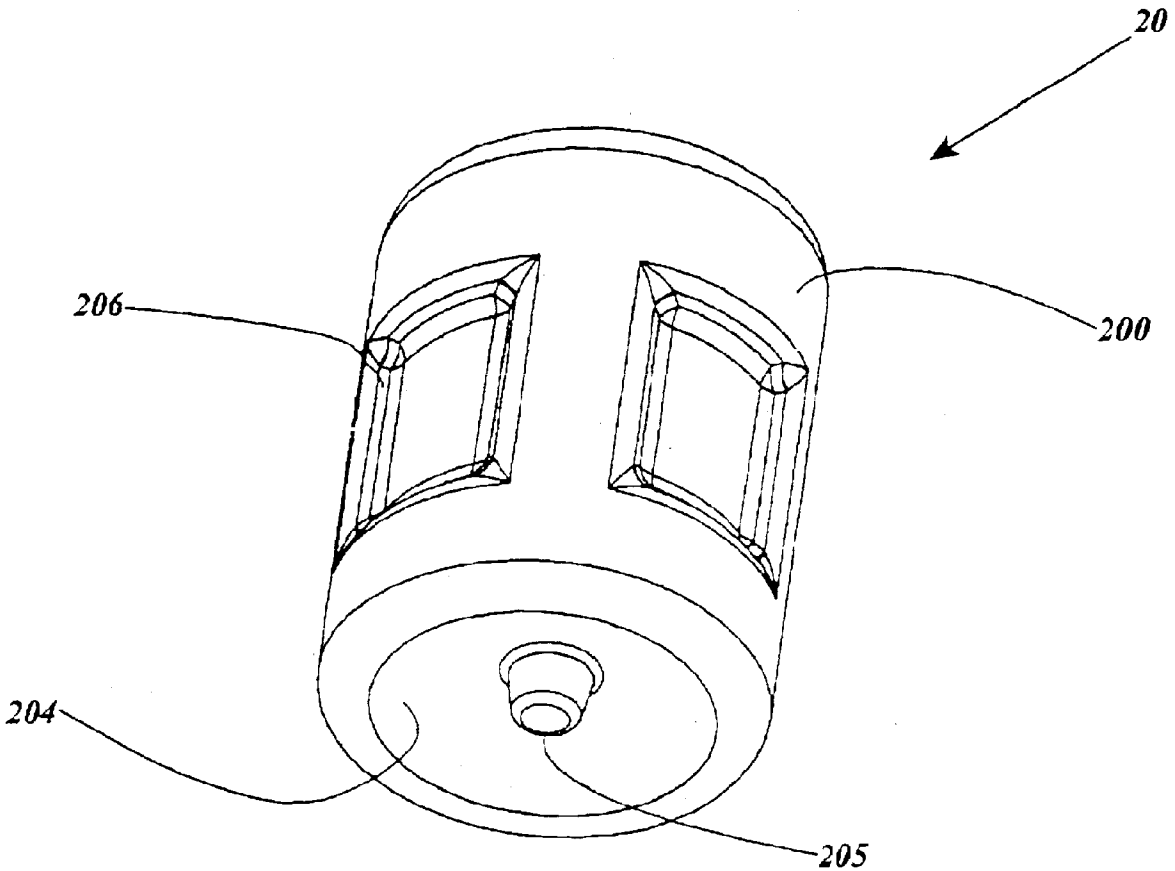
FIG. 6 shows the aerosol propellant receptacle valve seat protruding from the bottom wall of the aerosol propellant receptacle.
Figure 7:
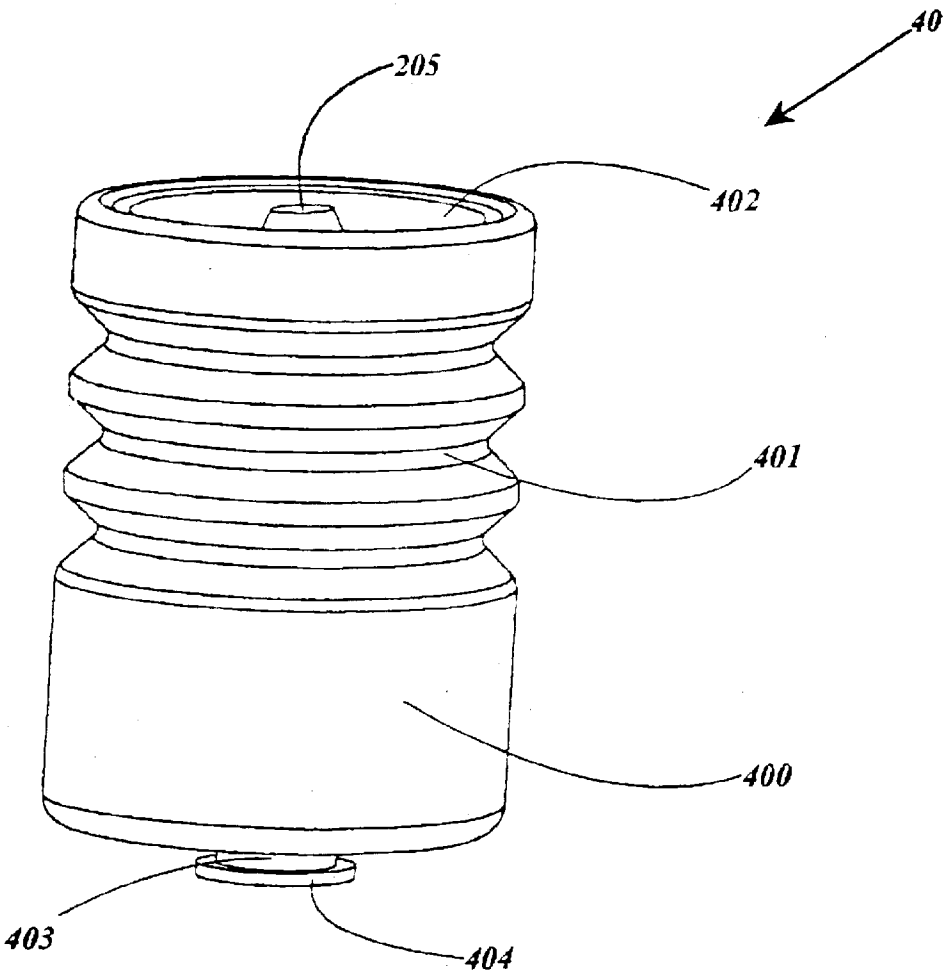
FIG. 7 shows another embodiment of the aerosol propellant receptacle with a bellows type body for raising and lowering the aerosol propellant receptacle valve seat unto the stem valve outer bottom edge, but with a simple flat bottom valve seat.
Figure 8:
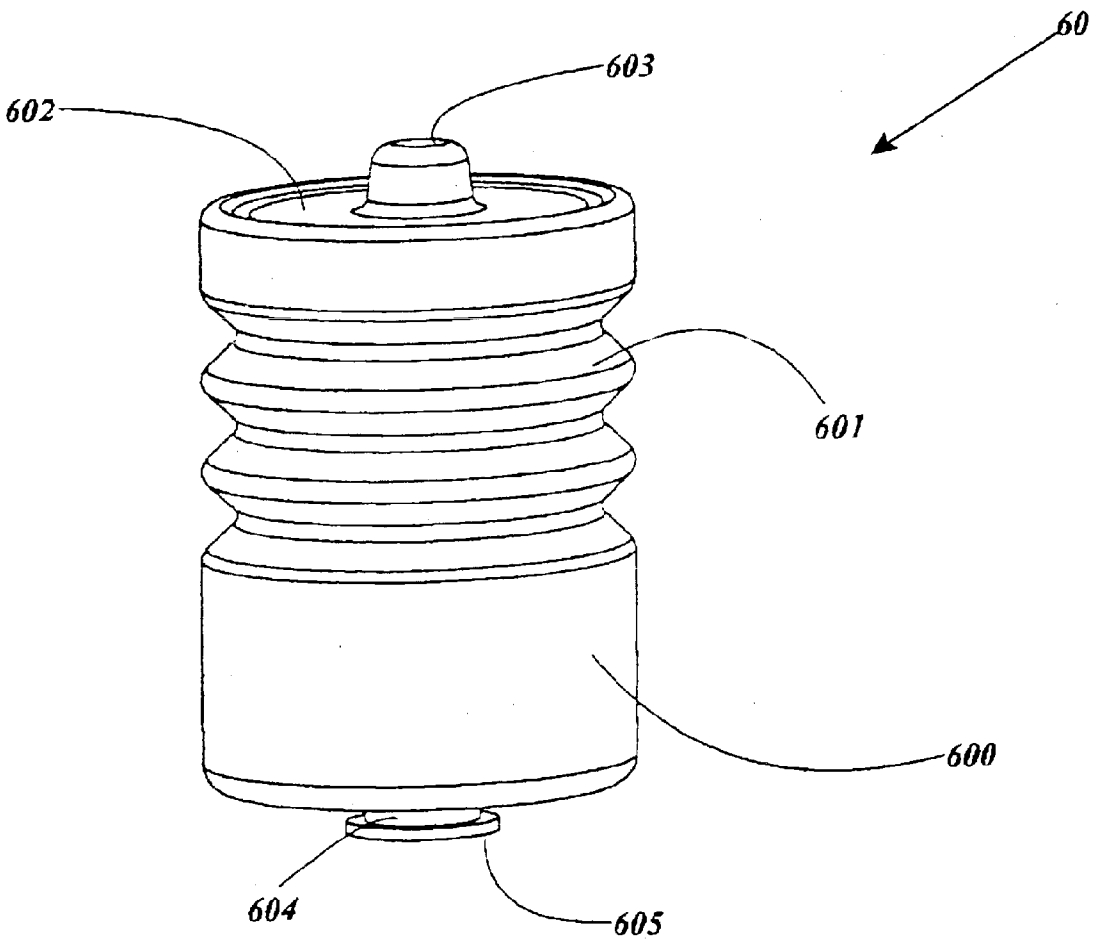
FIG. 8 shows the aerosol propellant receptacle of the embodiment of FIG. 6 with a conical aerosol propellant receptacle valve seat.
Figure 9:
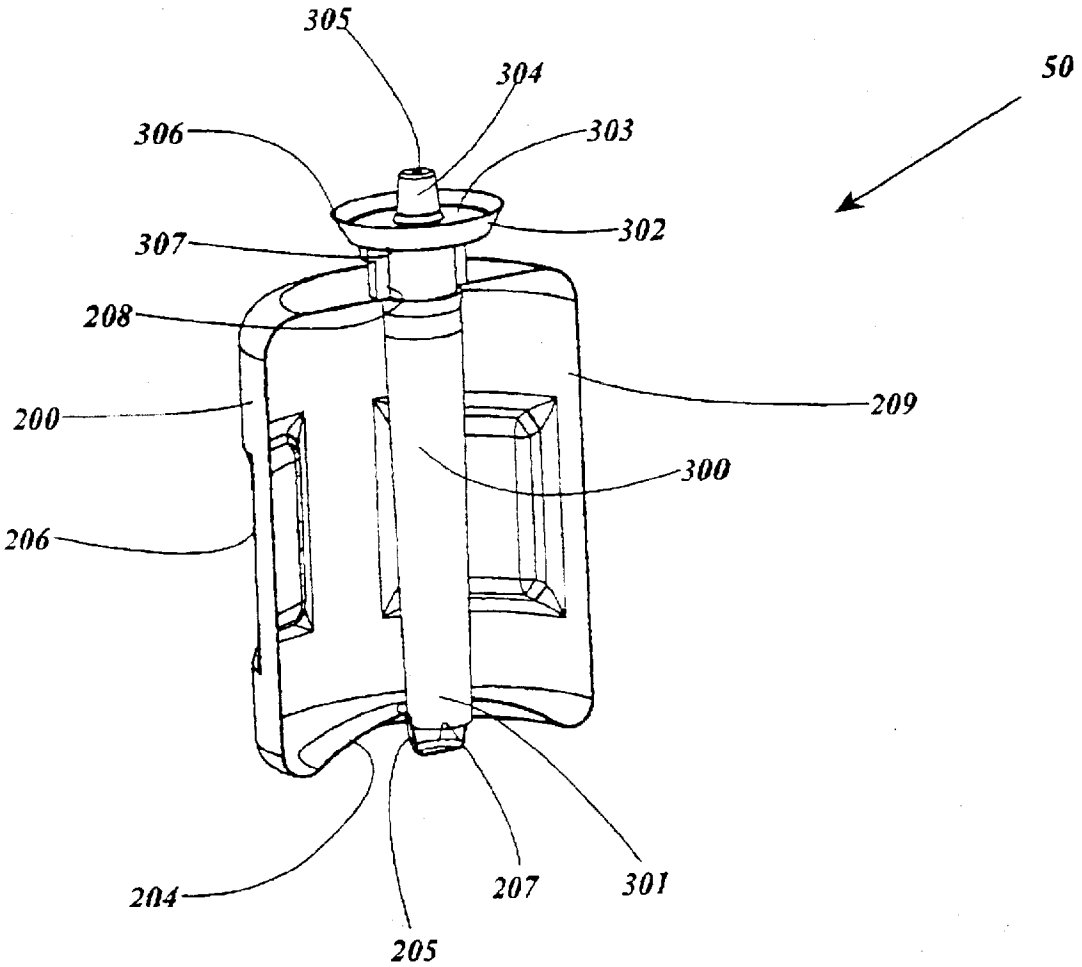
FIG. 9 shows a cut away view of the aerosol propellant receptacle with the stem valve attached therein, and the stem valve sealing cone sealing on the aerosol propellant receptacle valve seat, trapping water inside the aerosol propellant receptacle trapping water inside the aerosol propellant receptacle.
Figure 10:
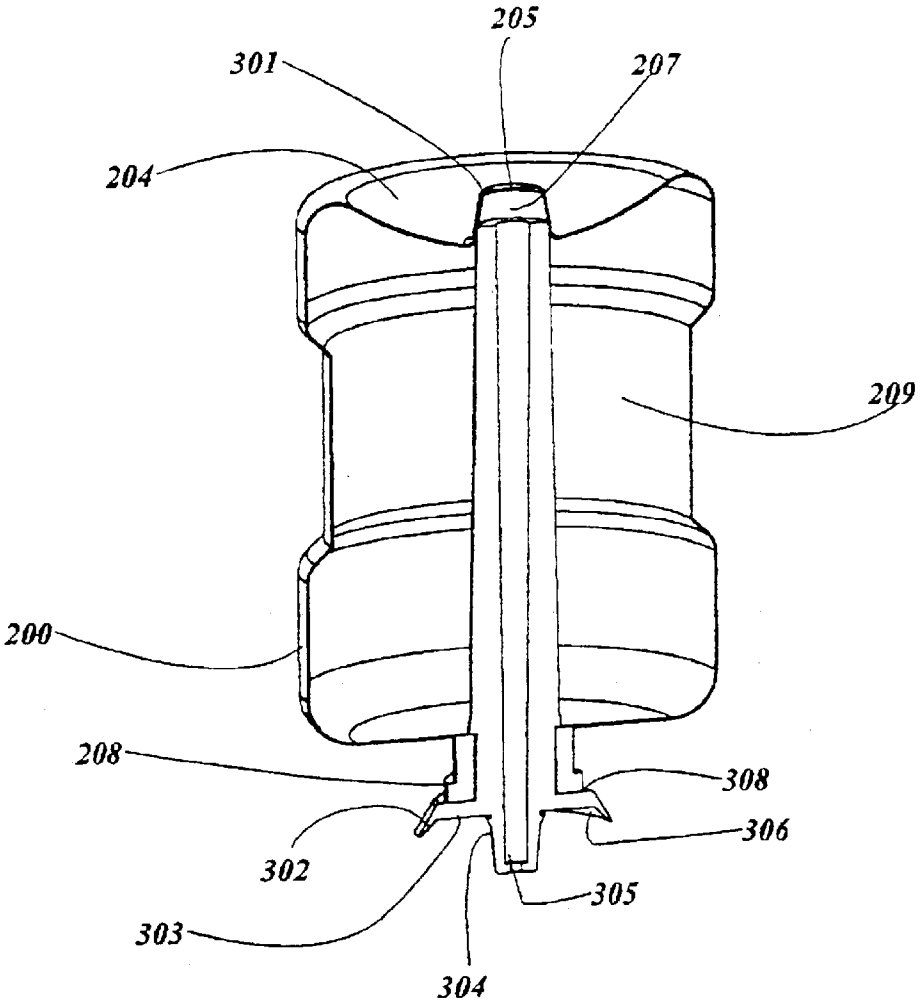
FIG. 10 shows the aerosol propellant receptacle and stem valve assembly and the stem valve through hole.
Figure 11:
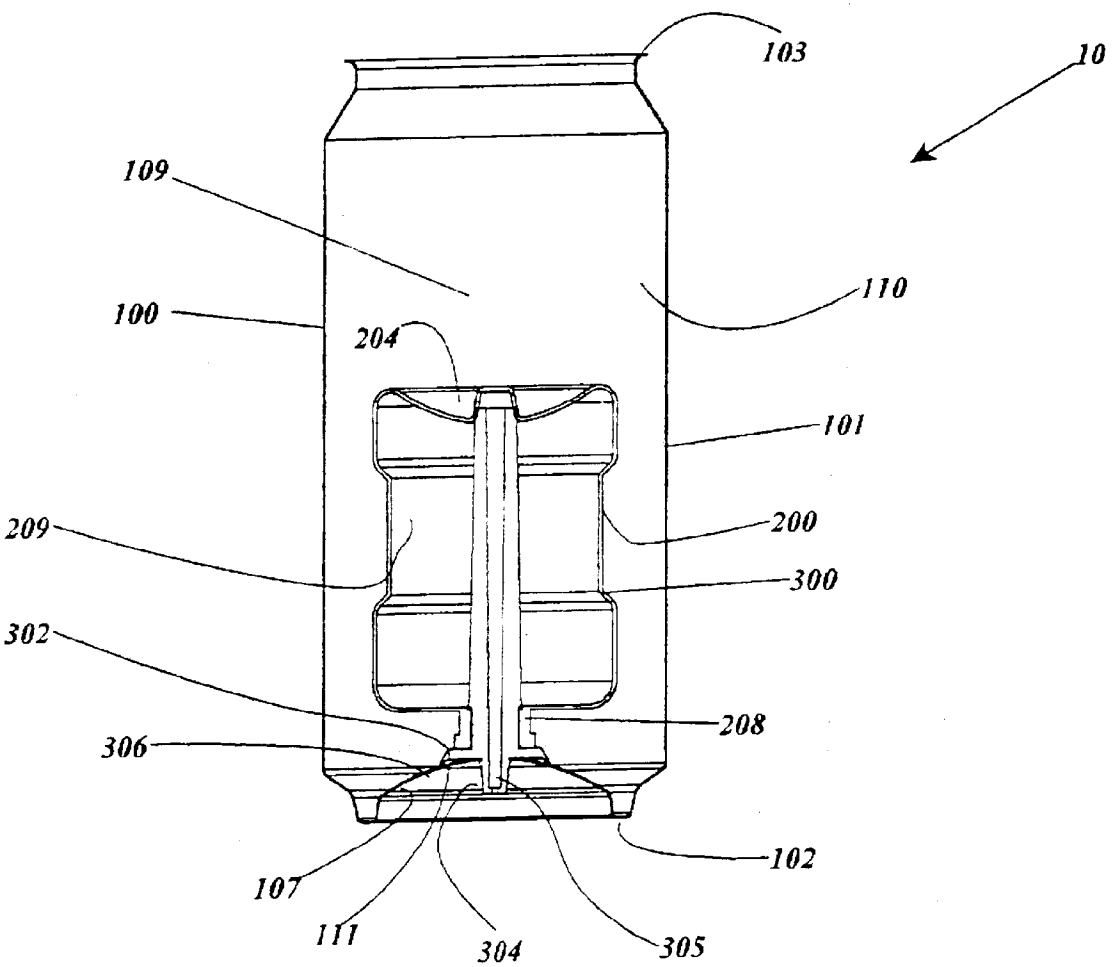
FIG. 11 shows a cut away view of the apparatus according to the preferred embodiment of the invention before the beverage is filled into the container, the aerosol propellant receptacle is filled with water, and the stem valve attached by a snap to a hole through the container bottom wall.
Figure 12:
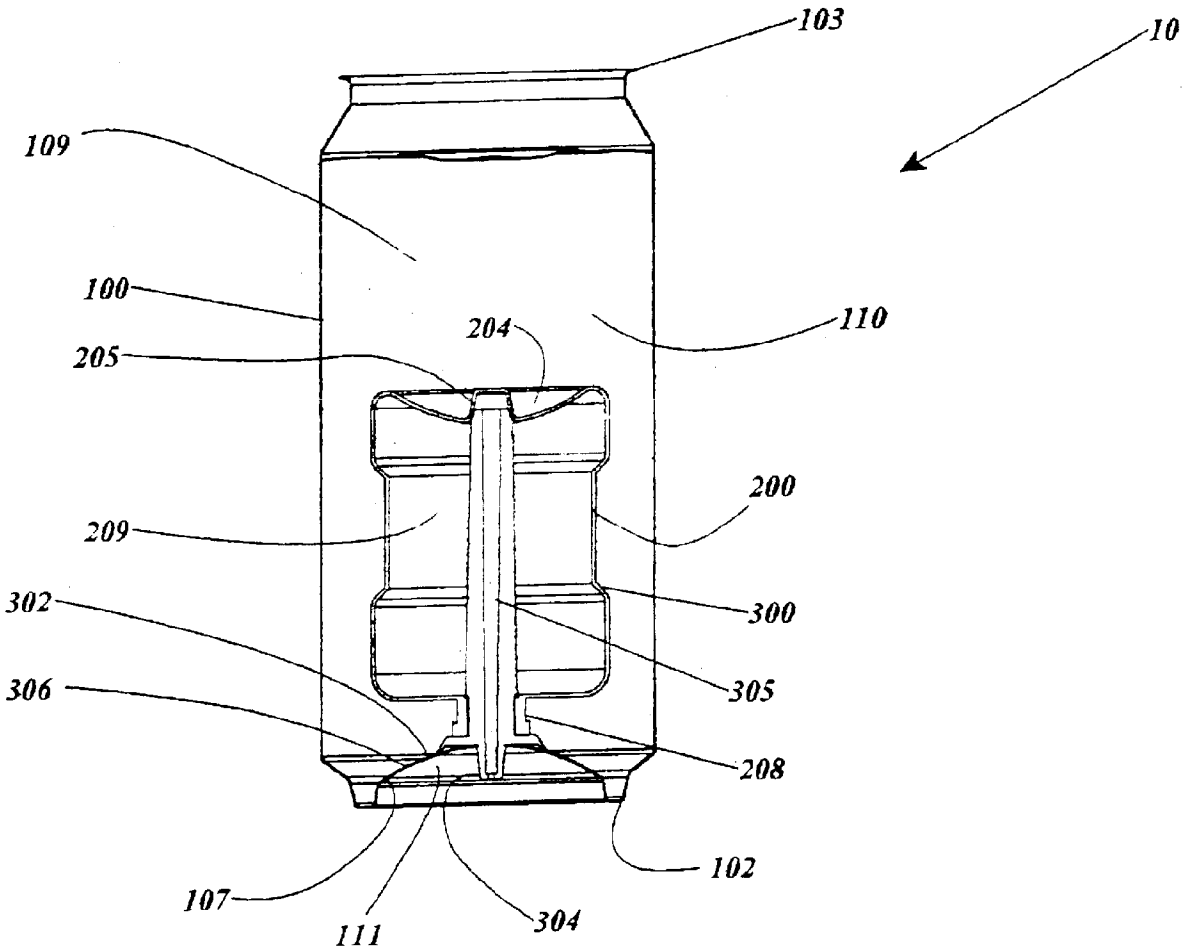
FIG. 12 shows a cut away view of the apparatus according to the preferred embodiment of the invention with beverage filled into the container and surrounding the aerosol propellant receptacle walls, the aerosol propellant receptacle filled with water, and the stem valve attached by a snap to a hole through the container bottom wall.
Figure 13:
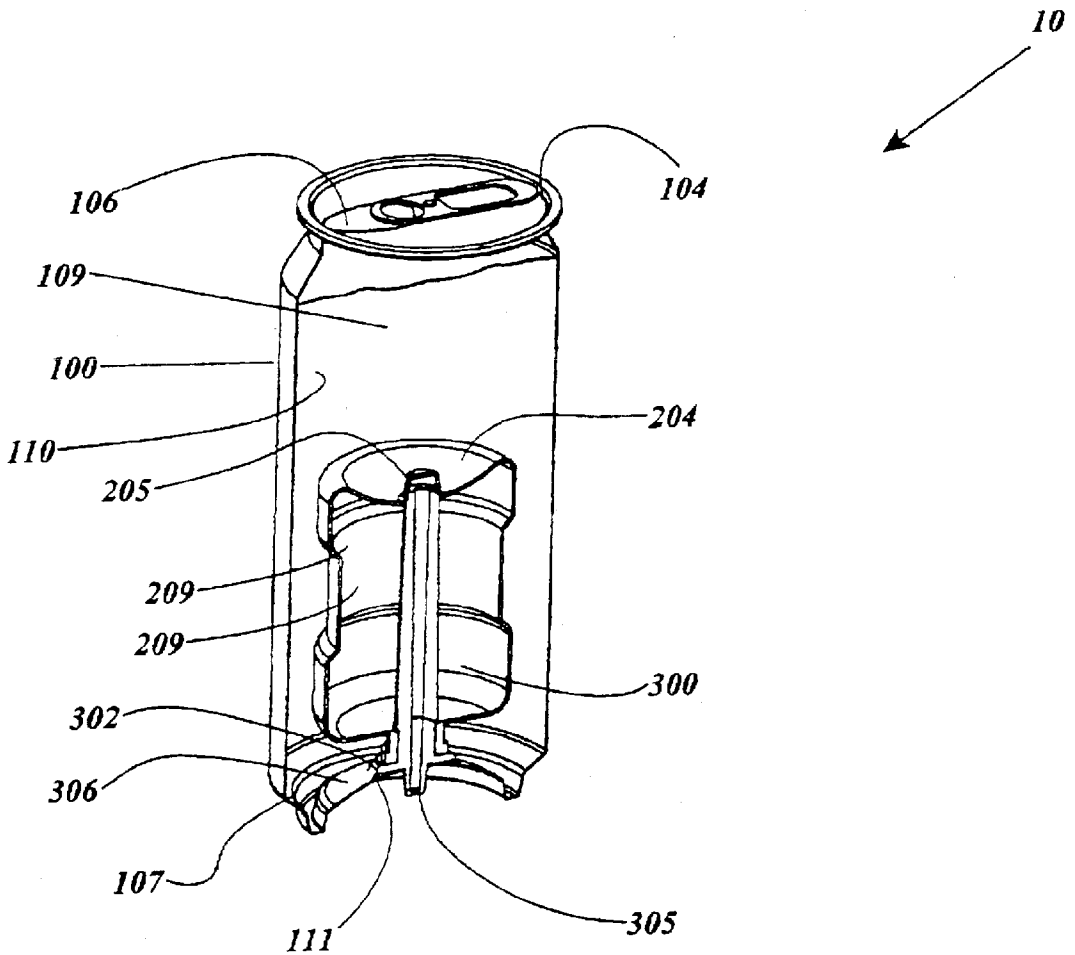
FIG. 13 shows the apparatus with the lid seamed unto the container to seal the beverage product and the aerosol propellant receptacle inside the container.
Figure 14:
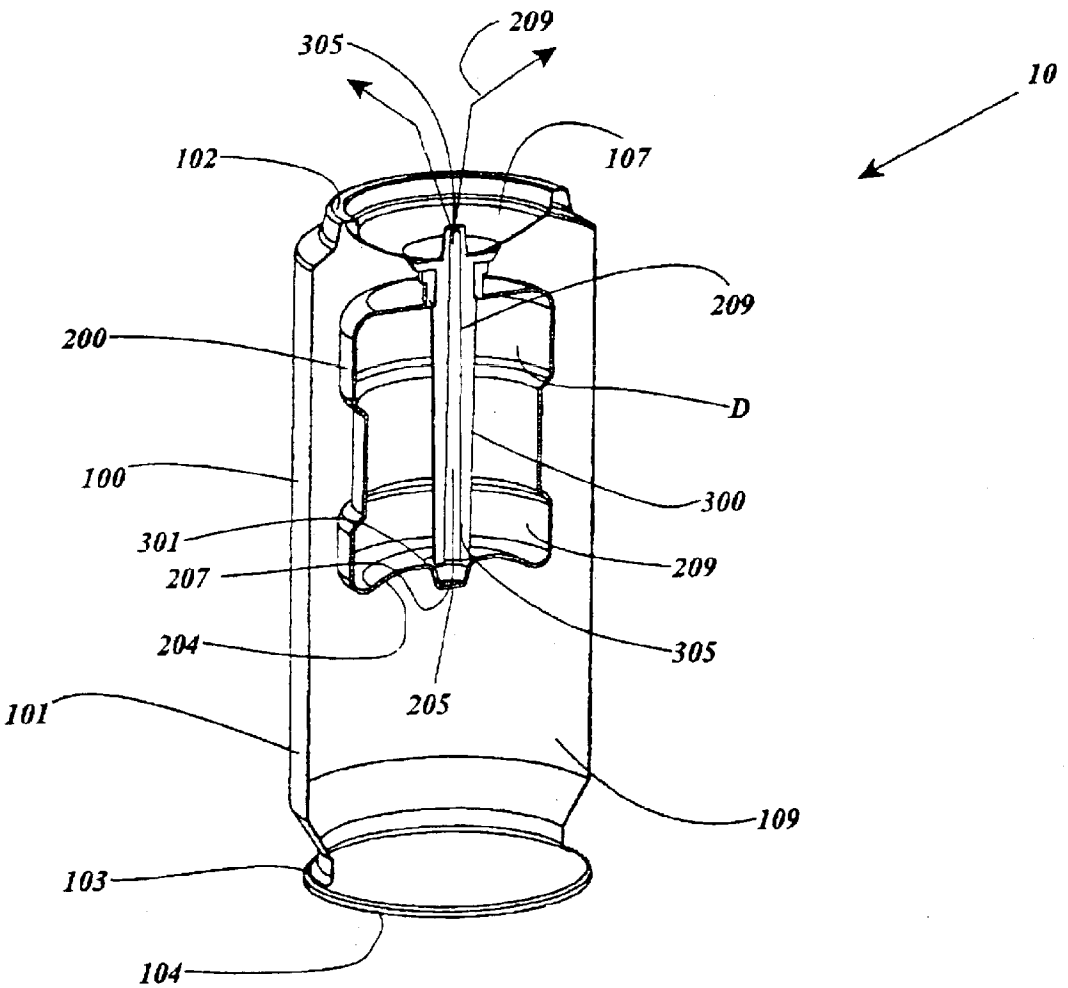
FIG. 14 shows the water in the aerosol propellant receptacle being expelled by the pressure of the liquified dose aerosol propellant.
Figure 15:
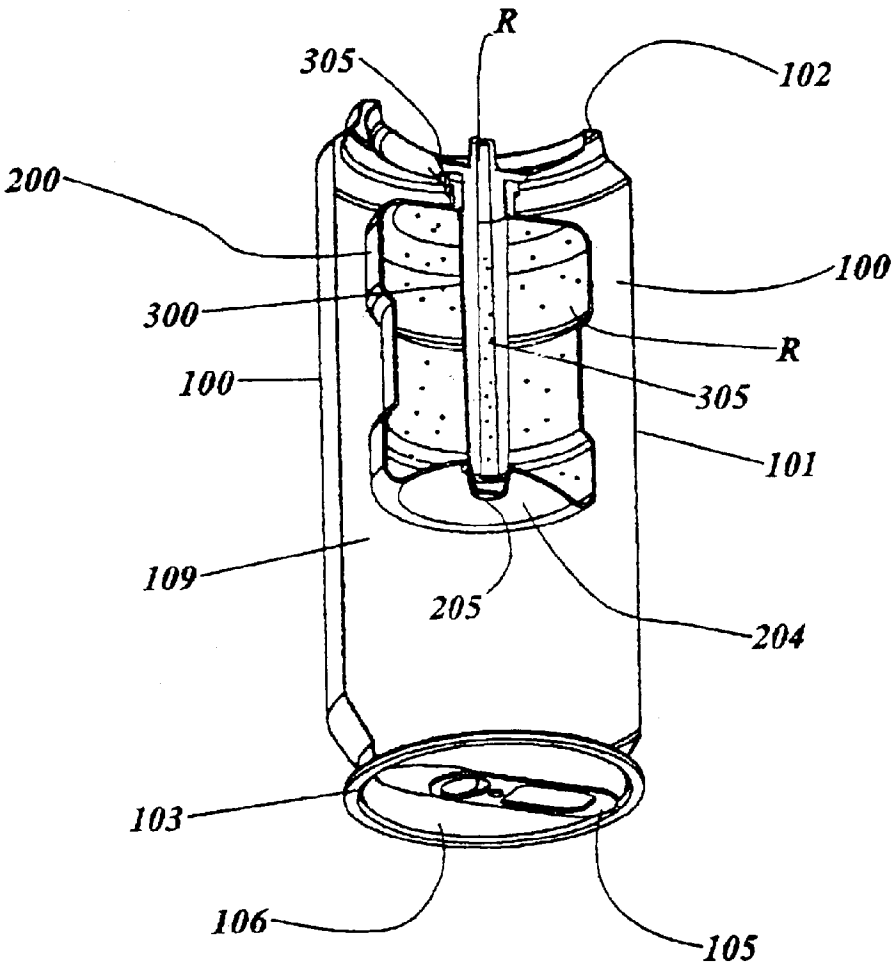
FIG. 15 shows the apparatus being charged with liquified aerosol propellant.
Figure 16:
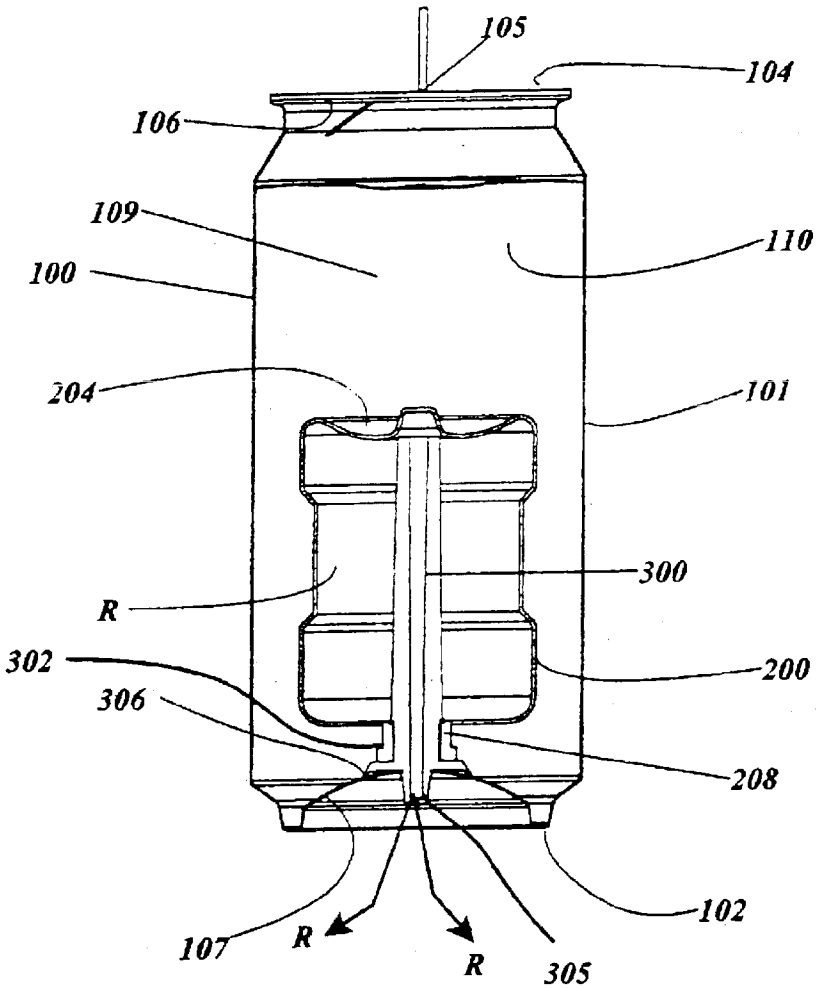
FIG. 16 shows the beverage container opening means opened to atmospheric pressure, and the aerosol propellant receptacle valve seat dislodged from the stem valve sealing cone breaking the seal for the liquified gas to escape from the aerosol propellant receptacle. The figure also shows that only the gaseous phase of the gas can escape when the container is opened.
Figure 17:
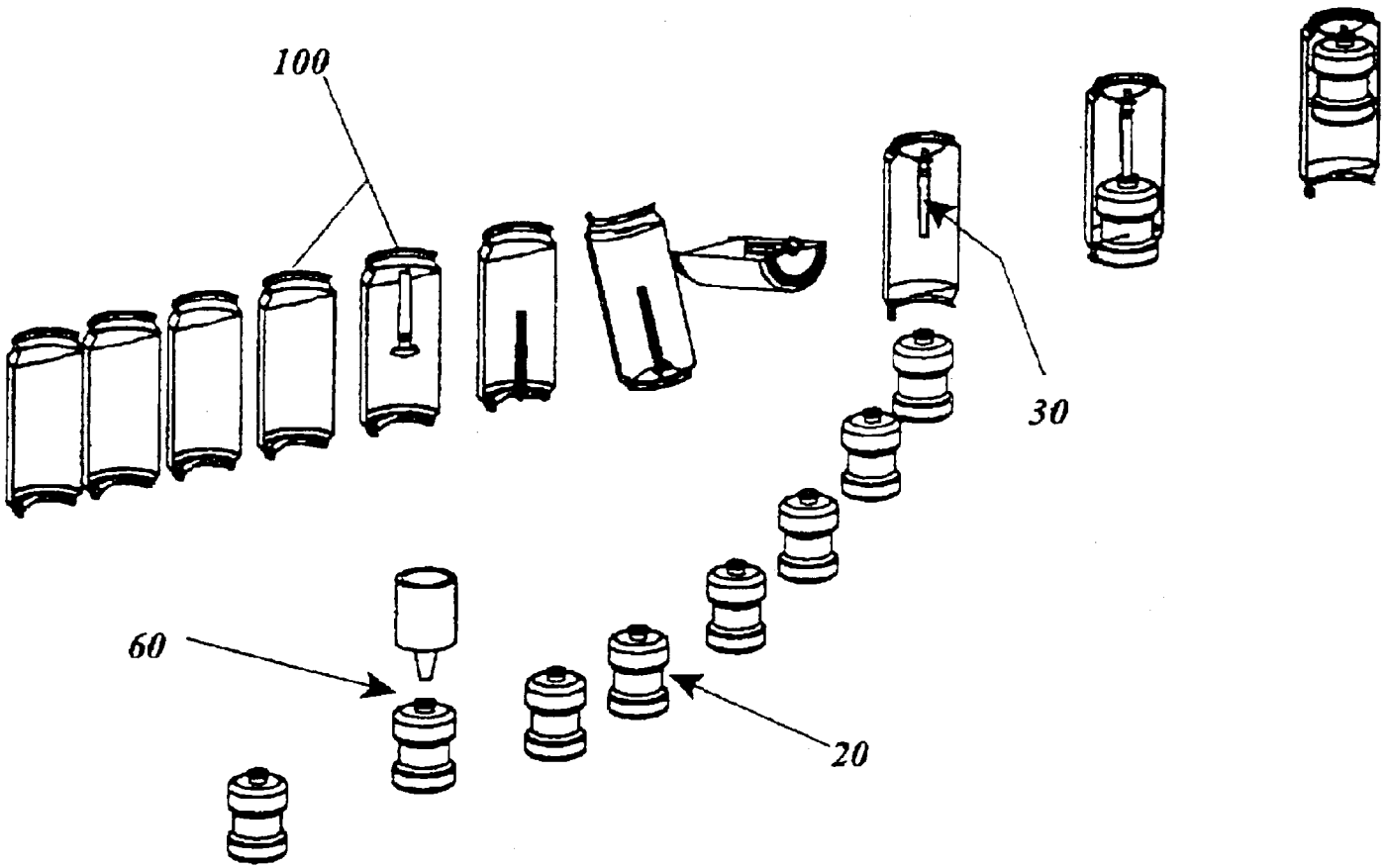
FIG. 17 shows a schematic of one embodiment of an assembly process for the apparatus, with water being poured into the aerosol propellant receptacle and the stem valve attached to the beverage container, and then the aerosol propellant receptacle being attached to the stem valve.
Figure 18:
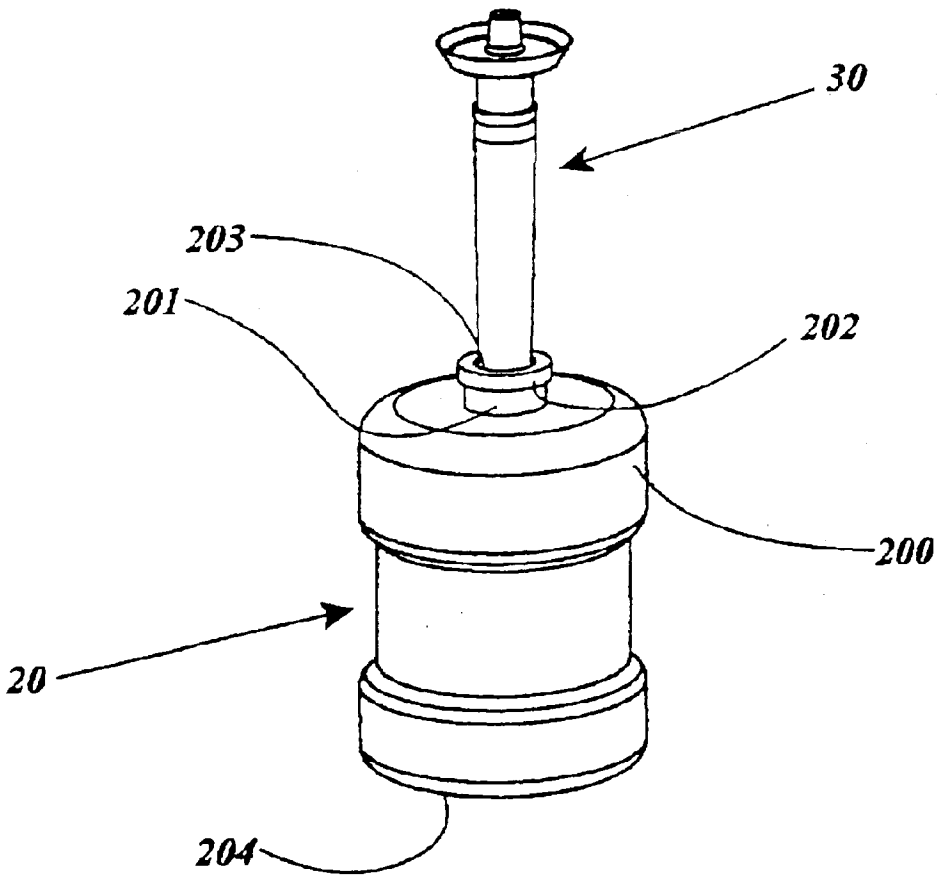
FIG. 18 shows the stem valve being inserted into the water filled aerosol propellant receptacle, as an example of the assembly process during which the aerosol propellant receptacle stem valve are first assembled before assembling the two with the beverage container.
Figure 19:
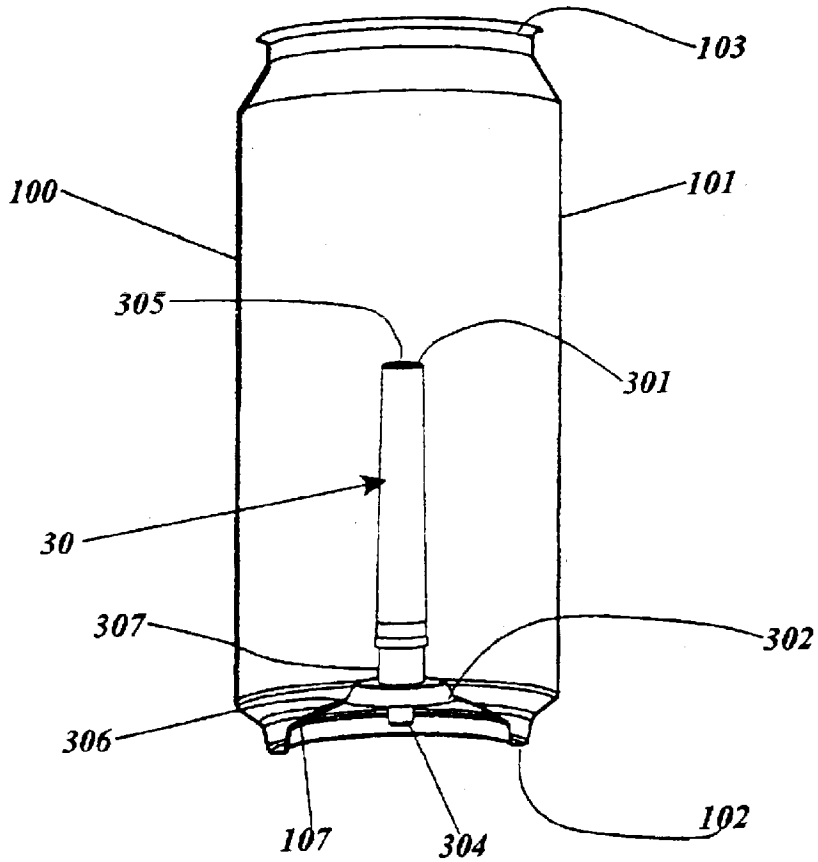
FIG. 19 shows the stem valve being assembled with the container bottom wall hole as an example of the assembly process during which the stem valve and the container are first assembled together before the water filled aerosol propellant receptacle is assembled with the stem valve.
Figure 20:
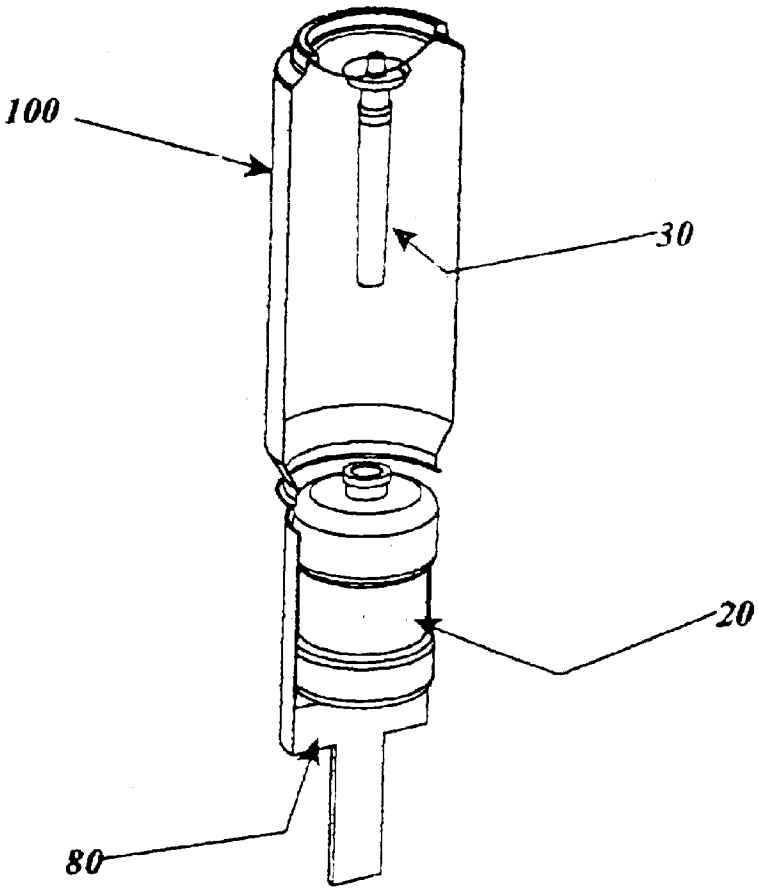
FIG. 20 shows a container with a valve stem attached and a rig for inserting the aerosol propellant receptacle into the valve stem.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, whenever the words liquified aerosol propellant are used, they also refer to aerosol propellant mixtures of an activated carbon matrix or Carbon Fullerine Nanotubes with a high pressure aerosol propellant such as CO2,N2, or other suitable gases.

Reference is now made to the drawings, wherein like characteristics and features of the present invention shown in the various FIGURES are designated by the same reference numerals.

Referring to FIGS. 1 AND 3–20, a self cooling beverage container apparatus 10 is disclosed.

In the first of the preferred of several possible embodiments, the apparatus 10 includes a conventional container 100 such as a metal or plastic can containing container contents 110 having a conventional unified domed container bottom wall 102, and a cylindrical container side wall 101 terminating in an upper container sealing rim 103. A container sealing lid 104 is also provided for sealing off the container contents 110 inside the container 100 with container sealing rim 103. A round container bottom wall hole 108 passes through the center of the domed container bottom wall 102.

The apparatus 10 further comprises a thin walled plastic or metal aerosol propellant receptacle 20 with substantially the shape of a small plastic or metal bottle with a bottle neck. With the said aerosol propellant receptacle 20 oriented so that it sits on a bottom wall 204 and with the open end facing an upwardly direction, the aerosol propellant receptacle 20 comprises a substantially horizontal round top wall 210 from the center of which wall is joined a short smaller diameter cylindrical aerosol propellant receptacle neck protrusion 201 which terminates with a thin aerosol propellant receptacle open neck round flange 202. Said aerosol propellant receptacle open neck flange 202 having a slightly larger diameter than the cylindrical aerosol propellant receptacle open neck protrusion 201. The aerosol propellant receptacle top wall 210 has a diameter that is greater than the diameter of the aerosol propellant receptacle open neck protrusion 201. The top wall 210 and the aerosol propellant receptacle open neck protrusion 201 form a continuous unified wall of the aerosol propellant receptacle 20 with the aerosol propellant receptacle open protrusion neck 201 forming a passage through the aerosol propellant receptacle top wall 210 as an entry way for ingredients that are to be stored inside the aerosol propellant receptacle 20. A aerosol propellant receptacle side wall 200 sealingly joins the aerosol propellant receptacle top wall 210 protruding in the downward direction to sealingly join a substantially round aerosol propellant receptacle bottom wall 204. Thus, the aerosol propellant receptacle 20 walls are all joined together to form continuous bottle with an open neck. The aerosol propellant receptacle bottom wall 204 is designed to be slightly flexible and to flex up and down the axis of the aerosol propellant receptacle 20, so as to increase the overall length of the aerosol propellant receptacle 20 when the pressure acting inside the aerosol propellant receptacle 20 walls is greater than the pressure acting outside the aerosol propellant receptacle 20 walls. In general the walls of the aerosol propellant receptacle 20 are flexible and thin relative to its size. The aerosol propellant receptacle 20 is also designed to be handled easily for manufacturing the self-cooling container so that the processes that would be encountered during the manufacturing would be easily accomplished because of the way the aerosol propellant receptacle 20 is designed and works. The aerosol propellant receptacle 20 is also designed to store a liquified aerosol propellant A at a minimal pressure far less than the aerosol propellant A phase pressure by means of equilibration with carbonation beverage pressure, and when the aerosol propellant A pressure acting inside the aerosol propellant receptacle 20 walls equilibrates with beverage pressure acting outside the aerosol propellant receptacle 20 walls. The aerosol propellant receptacle sealed bottom wall 204 is flexible. A substantially conical valve seat 205 protrudes outwardly in a downward direction from the center of the aerosol propellant receptacle bottom wall 204 to form a valve seat 205. The inside surface of valve seat 205 forms a valve seat recess 207, which is designed to sealingly mate with the sealing cone 301 of a substantially tubular stem valve 30, so that liquified aerosol propellant A contained inside the aerosol propellant receptacle 20 will not boil and escape from within the aerosol propellant receptacle 20 when the force generated by the pressure acting outside walls of the aerosol propellant receptacle 20 is greater than the pressure of the aerosol propellant A acting on the inside walls of the aerosol propellant receptacle 20. Advantageously, the aerosol propellant receptacle 20 valve seat recess 207 will not form a seal with the sealing cone 301 if the force due to pressure acting on outside of the aerosol propellant receptacle 20 walls is less than the force due to the liquified aerosol propellant A pressure acting on inside walls of the aerosol propellant receptacle 20. Conventional aerosol propellant storage systems simply store aerosol propellant in a phase equilibrium state so that the gas phase pressure is equal to the liquid phase pressure. However aerosol propellant receptacle 20 is designed to store the liquified aerosol propellant A in a phase locked condition, so that the gaseous phase is at a pressure slightly higher than that required to liquify the aerosol propellant A at the temperature of the liquified aerosol propellant R. Advantageously, a higher packing fraction of liquified aerosol propellant A to aerosol propellant receptacle 20 volume can be achieved by this invention. The expected maximum packing fraction is recorded by empirical studies, is about 90%.

The apparatus 10 further comprises a stem valve 30 for mating with and forming a valve seal with aerosol propellant receptacle 20. The stem valve 30 is essentially a tubular valve that mates with aerosol propellant receptacle 20. Stem valve 30 comprises a short cylindrical tube 308 of a length of about ½ inches and diameter ⅜ inch which protrudes from the bottom surface 307 of a sealing cup flange 302 and connects to a conical tube stem valve body 300 of a length of about 3 inches. Sealing cup flange 302 is shaped like a shallow suction cup of a diameter of approximately 1 inch and a depth of about ¼ inch, for sealing against container domed inside bottom wall 107 of the beverage container 100. The dimensions given are only for the sake of comparative clarity of the present invention, and should not be construed as the only possible dimensions for the parts of the apparatus 10. A short small cylindrical stud 304 protrudes from the inside surface of the sealing cup flange 303 in the opposite direction to the stem valve body 300. The approximate diameter of the stem valve stud 304 is ¼ inch, but it could be larger or smaller depending on the size of the beverage container 100 the apparatus 10 is designed for. A small stem valve hole 305 passes through the entire length of the stem valve 300. The stem valve hole 305 could be made larger inside the stem valve body 300, for reasons of ease of manufacturing. The approximate diameter of the stem valve hole 305 is about 0.04 inches. Again all of the dimensions sited are examples of one embodiment of the invention. The stem valve cylindrical stud 304 is designed to tightly push or snap into container bottom wall hole 108 to hold the aerosol propellant receptacle 20 and stem valve 30 aerosol propellant receptacle and valve assembly 50 centrally inside the beverage container 100. The sealing cup flange 302 forms a tight seal against the container domed inside bottom wall 107 of the beverage container 100 when the stem valve stud 304 is tightly pushed into the container bottom wall hole 108.

In yet another mode of assembling the apparatus 10, a first step is affixing the stem valve 30 to the aerosol propellant receptacle 20 by passing the stem valve body 300 through the aerosol propellant receptacle neck protrusion opening 203, so that the stem valve cylindrical body 308 seals against the inside surface 208 of the aerosol propellant receptacle neck cylinder 201, and the bottom surface 307 of the stem valve sealing cup flange 302 sealingly mates to outer surface of the aerosol propellant receptacle open neck flange 202. The stem valve 30 is designed to fit snugly and tightly into the aerosol propellant receptacle neck protrusion opening 203, so that a gas tight plug is formed around the aerosol propellant receptacle open neck flange 202. The stem valve 30 is made long enough so that when the bottom surface 307 of the sealing cup flange 302 mates with the aerosol propellant receptacle open neck flange, the conical stem valve body 301 also sealingly abuts the surface of the aerosol propellant receptacle valve seat recess 207. Thus, when the sealing cone 301 abuts the valve seat recess 207 of valve seat 205, pressurized aerosol propellant gas A cannot escape through the stem valve hole 305, or through the aerosol propellant receptacle neck protrusion opening 203. Other methods of practicing the invention do not require that the sealing cone 301 seal the surface of the aerosol propellant receptacle valve seat recess 207 when the stem valve flange 302 is fully seated on the aerosol propellant receptacle open neck flange 202. It is important that the sealing cone 301 be close to or actually contact the inside surface 207 of the aerosol propellant receptacle valve seat recess 207, so that if the pressure inside the aerosol propellant receptacle 20 is less than the pressure outside the aerosol propellant receptacle 20, the aerosol propellant receptacle bottom wall 204 is deflected inwardly to make contact between the inner surface 207 of the aerosol propellant receptacle valve seat recess 207 and the sealing cone 301 to form a gas tight seal that traps any liquified or gaseous aerosol propellant inside the aerosol propellant receptacle 20 from escaping to the outside through the stem valve hole 305.

To manufacture the apparatus 10, the aerosol propellant receptacle 20 is first filled with clean water 209. The stem valves 30 are then inserted into the aerosol propellant receptacle 20 through the aerosol propellant receptacle neck protrusion opening 203 to displace some water 209 and form a seal with the aerosol propellant receptacle open neck flange 202 and the inside surface 207 of the aerosol propellant receptacle valve seat recess 207. Thus the water 209 is trapped inside the aerosol propellant receptacle 20 and cannot pass through the stem valve hole 305, or the aerosol propellant receptacle protrusion neck opening 203. The aerosol propellant receptacle and valve assembly 50 is then inserted into the beverage container 100, and the stem valve stud 304 is aligned and pushed through the container bottom wall hole 108. The stem valve stud 304 is made slightly larger than the container bottom wall hole 108, so that as the stem valve stud 304 pushes into the container bottom wall hole 108, the stem valve stud 304 forces the container bottom wall hole 108 rim 112 to deform around the rim 112 into a small conical ring 113 of the container 100 material protruding out of the container 100. This conical ring 113 of material forms a tight swage fitting that holds the stem valve stud 304 firmly in place on the container 100. A snap action may also be used for this attachment. The deforming of the container bottom wall hole 108 into a substantially conical rimed hole 114, causes the container wall material to bight into the softer stem valve stud 304 material and form a hematic seal, and a very tight strangle hold on the valve stud 304. The stem valve 30 is pushed into the container bottom hole 108 until the stem valve sealing cup 302 flange makes a tight cup seal between the stem valve 30 and the container domed inside bottom wall 107. Thus, container bottom wall hole 108 deforms to a substantially conical rimmed hole 114 holding the aerosol propellant receptacle and valve assembly 50 in place inside container 100. The apparatus 10 is then transported to a beverage filling plant, where the apparatus 10 is filled with container contents 110 under carbonation pressure in the annular space formed by the boundary of aerosol propellant receptacle and valve assembly 50 and the inside of container 100. The sealing cup flange 302 has a cup wall 306 that seals against the domed surface of the container domed inside bottom wall 107.

During the beverage filling process, a filler head is sealed against the beverage container sealing rim 103. Nitrogen or carbonation pressure is transmitted from the beverage filler head to the inside space 109 of the beverage container 100. This pressure is also fully transmitted to the aerosol propellant receptacle 20 outer walls. The pressure within the aerosol propellant receptacle 20 builds up and equilibrates with the pressure of the carbonation gas inside the beverage container 100. The pressure outside the aerosol propellant receptacle 20 causes the aerosol propellant receptacle bottom wall 204 to deform slightly, pushing against the trapped water 209 in the aerosol propellant receptacle 20 until the aerosol propellant receptacle valve seat recess 207 inside surface 207 seals tightly against the sealing cone 301 of the conical stem valve body 301. This stops any water 209 from escaping from the aerosol propellant receptacle 20. Since the aerosol propellant receptacle 20 is now filled with only water 209, and water 209 is essentially incompressible, minimal deformation of the aerosol propellant receptacle 20 walls occurs preventing any damage to the thin aerosol propellant receptacle 20 walls. The pressurization of the container 100 with carbon-dioxide gas is important when carbonated container contents 110 is being filled to ensure that the carbonation of the container contents 110 occurs during the filling process. The container contents 110 itself is usually carbonated when it enters the container 100, where, because of the absorption of pressurized carbon-dioxide gas, it becomes highly carbonated. For a container 100 without the aerosol propellant receptacle 20, the container 100 column strength is obtained by the filler head firmly forming a seal with the empty open container sealing rim 103 and pressurizing the container 100 directly with a blast of carbon-dioxide gas. The column strength of the container 100 is obtained by the internal pressure of the container 100. This allows the filler head to firmly seal the container sealing rim 103 to maintain the pressure of the container contents 110 during the filling process. Thus it is important that the above steps be taken in manufacturing a useful self-cooling beverage container. Absence of water 209 could cause the aerosol propellant receptacle 20 walls to collapse and prevent column strength from building up, thus causing the container 100 to collapse under the filler head forces. Thus, during filling, the aerosol propellant receptacle 20 advantageously transmits the filler head forces directly to the water 209 without subjecting the container 100 walls or the aerosol propellant receptacle 20 walls to deformation stresses.

The method of manufacture of the aerosol propellant receptacle 20 generally involves the broad steps of injection molding preforms 600 from suitable plastic materials; blow molding the aerosol propellant receptacle 20 to a shape of particular form; orienting the aerosol propellant receptacle 20 for filling with water 209; inserting the stem valve 30 into the aerosol propellant receptacle 20; and insertion the aerosol propellant receptacle and valve assembly 50 into beverage containers 100 so that the stem valve stud 304 is pushed to a tight fit into the container bottom wall hole 108; filling the beverage container 100 with container contents 110; seaming the container lid 104 onto the container sealing rim 103; checking for carbonation column strength of the filled and seamed container 100. The steps further comprise; the broad steps of ejecting the water 209 in the aerosol propellant receptacle 20 by pressure feeding a small dose of higher liquified aerosol propellant D into the aerosol propellant receptacle 20 through the stem valve hole 305; said aerosol propellant D opening the seal made between the inside surface 207 of the valve seat recess 207 and the sealing cone 301; using a high pressure piston charger to charge liquified aerosol propellant D through the stem valve hole 305 into the aerosol propellant receptacle 20; storing the apparatus 10 for later sale or use by a consumer.

It is important to know that the liquified phase of the aerosol propellant A to be used for cooling may be either at a lower or higher pressure than the carbonation pressure $P_B$ of container contents 110. This is so because the force generated by the pressure $P_B$ of container contents 110 acting on the outside walls of aerosol propellant receptacle 20 must always be able to overcome the force generated by the pressure $P_R$ of aerosol propellant A acting on the inside surfaces of the aerosol propellant receptacle 20 walls in order to force the inside surface 207 of the aerosol propellant receptacle valve seat recess 207 to form a seal with the sealing cone 301 and trap aerosol propellant A during storage. Also, as the pressure $P_B$ of container contents 110 inside container 100 builds up, the pressure $P_B$ compresses the aerosol propellant receptacle bottom wall 204 and forces the aerosol propellant receptacle bottom 204 wall to bow inward into aerosol propellant receptacle 20. This forces the valve seat recess 207 to mate with stem valve sealing cone 301. Thus, the net projected surface area of the aerosol propellant receptacle bottom that is exposed to the aerosol propellant A pressure $P_R$ is equal to the area of the aerosol propellant receptacle bottom wall 204 minus the area of the inside surface 207 of the valve seat recess 207. This are is always less than the outer surface area of aerosol propellant receptacle bottom wall 204 that is exposed to the carbonation pressure $P_B$ of container contents 110. This difference in areas is equal to the amount of the surface area trapped between the inside surface 207 of the aerosol propellant receptacle valve seat recess 207 and the sealing cone 301. Thus by adjusting this area, the aerosol propellant A pressure $P_R$ may be made to always exert a force on the aerosol propellant receptacle bottom wall 204 that is less than force exerted by the pressure $P_B$ of container contents 110 on said aerosol propellant receptacle bottom wall. Thus, advantageously, the inside surface of valve seat recess 207 and sealing cone 301 will forcibly mate by this pressure difference and seal off the stem valve hole 305 from the aerosol propellant A completely so that no aerosol propellant A can escape from the inside of aerosol propellant receptacle 20 to atmosphere. During the storage of the unit, this force difference is used to trap aerosol propellant A in a liquid phase-locked state with little or no gaseous phase in aerosol propellant receptacle 20. This is a very efficient way for storing a liquified gas. As stated earlier, if careful calculations are done, it is possible to have the aerosol propellant A pressure equal or greater than the carbonation pressure by adjusting the amount of tapped surface area between the valve seat recess 207 and the sealing cone 301. This makes it possible to use other suitable aerosol propellant of a wider pressure range relative to the product pressure, $P_B$. The difference in pressure can be estimated by the following formula:

$$P_R \leq \frac{(P_B - P_S)D^2}{(D^2 - d^2)}$$

where $P_R$ is the maximum pressure of the aerosol propellant A to be used, $P_B$ is the pressure of the carbonated beverage, and $P_s$ is the security difference in pressure to be used for the sealing of the aerosol propellant A during storage, and D is the diameter of the bottom aerosol propellant receptacle wall 204, and d is the diameter of the sealing cone 301. $P_s$ is nominally found to be about 5 psi under normal temperature conditions during summer in the State of Florida, USA. In other ambient conditions, the value of $P_s$ will depend on the variability of the carbonation pressure and the aerosol propellant A pressure with ambient conditions, particularly, temperature.

Thus by adjusting the values of d and D in any given design, the aerosol propellant A pressure $P_R$ could be determined for any given stem valve 30 and aerosol propellant receptacle 20 dimensions d and D and given beverage 110 pressure $P_B$. This offers a great variability in the possible types of aerosol propellant A that could be used for cooling the beverage 110, and a variety of embodiments could be constructed.

Since by design the carbonation beverage pressure $P_B$ will always form a seal for the aerosol propellant A in the aerosol propellant receptacle 20, the removal of the trapped water 209 in the aerosol propellant receptacle 20 is a little demanding. This is achieved by using a higher pressure liquid dose aerosol propellant D other than the aerosol propellant A to be stored in the aerosol propellant receptacle 20. This small liquid dose of aerosol propellant D must always produce a force that tends to open the valve seal. This can be achieved if the pressure $P_D$ of the liquid dose aerosol propellant D, follows the relation, $$P_D > \frac{(P_B + P_S)D^2}{(D^2 - d^2)}.$$

For example if the carbonation pressure $P_B$=50 psi, and if D=1.86, d=0.25, with a safety pressure lock of $P_s$=5 psi, the aerosol propellant A pressure must be given by, $$P_R \leq \frac{(50-5)1.86^2}{(1.86^2 - .25^2)} = 45.83 \text{ psi}$$

and the liquid dose aerosol propellant D pressure required to evacuate the water 209 from the aerosol propellant receptacle 20 must be greater than $$P_D > \frac{(50+5)1.86^2}{(1.86^2 - .25^2)} = 56.01 \text{ psi}$$

With the liquid dose aerosol propellant D pressure higher than the aerosol propellant A pressure, carbonation pressure, the liquid dose aerosol propellant D is able to maintain the stem valve 30 and the aerosol propellant receptacle valve seat recess 207 in a relatively open state until all the water 209 and liquid dose aerosol propellant D has escaped from the aerosol propellant receptacle 20. Some liquid dose aerosol propellant D in a gaseous form will remain in the aerosol propellant receptacle 20 to keep the aerosol propellant receptacle 20 walls from collapsing under carbonation pressure.

Upon complete or almost complete removal of the water 209 from the aerosol propellant receptacle 20, the remaining liquid dose aerosol propellant D will be in gaseous form at pressure $P_D$ and will equilibrate with the beverage pressure $P_B$. The liquified aerosol propellant A that is to be stored in the aerosol propellant receptacle 20 is then injected through the stem valve hole 305 into the aerosol propellant receptacle 20 by a pressure assist piston pump in a liquified state into the aerosol propellant receptacle 20. This has the advantage of completely filling the aerosol propellant receptacle 20 with liquified aerosol propellant A without deforming the aerosol propellant receptacle 20 walls. Upon completion of the charging, carbonation pressure $P_B$ immediately overcomes the aerosol propellant A pressure $P_R$ acting on the aerosol propellant receptacle bottom wall 204 and pushes valve seat 205 to reseat the valve seat recess 207 against the sealing cone 301, trapping the liquified aerosol propellant A inside the aerosol propellant receptacle 20. Thus the container 100 is now filled with the beverage 110, and the beverage 110 surrounds the aerosol propellant receptacle 20 which has the cooling aerosol propellant A within it. The completed assembly apparatus 10 is then stored or shipped to a customer for consumption The process of activation involves simply opening the container lid opening means 105 for consumption, so that the carbonation beverage pressure $P_B$ falls to atmospheric pressure, and the pressure of the liquified aerosol propellant R, $P_R$ acting on the internal walls of the aerosol propellant receptacle 20 causes the aerosol propellant receptacle bottom wall 204 to expand outwards pushing valve seat 205 away from the sealing cone 301, and breaking the aerosol propellant A seal between valve seat recess 207 and the sealing cone 301. Since when the container 100 is in the upright position the sealing cone 301 is above the liquid level of the aerosol propellant liquid mixture A, only aerosol propellant gas A is released through the bottom of the container 100 through the stem valve hole 305. This also has the advantage of preventing liquified aerosol propellant A from exiting the container 100 and causing free burns, since the container 100 contents will spill if the container 100 is tilted from the upright position.

To operate the present invention for use as a self-cooling container, no additional activation means is provided other than the beverage container lid opening means 105. Thus a consumer does not have the opportunity to tamper with the unit unless the consumer intends to open the beverage container 100 for consumption. The opening of the beverage container 100 for consumption simultaneously opens the aerosol propellant receptacle valve 205 and aerosol propellant A mixture is progressively discharged in a gaseous phase from the aerosol propellant receptacle 20 through the stem valve hole 305 as it extracts heat from the beverage 110 and evaporates. A process of manufacturing the above-described self-cooling container apparatus 10 for retaining container contents 110 is provided, including the steps of orienting the stem valves 30 for insertion into the aerosol propellant receptacles 20; filling the aerosol propellant receptacles 20 with water 209; inserting the stem valves 30 into the aerosol propellant receptacles 20; and inserting the assemblies 50 into beverage containers 100; filling each beverage container 100 with beverage 110; seaming or crimping the container lid 104 onto the container 100; then piston pumping a high pressure liquified aerosol propellant dose D into the aerosol propellant receptacle 20 to exhaust the water 209 from the aerosol propellant receptacle 20; then piston pumping liquified aerosol propellant A into the aerosol propellant receptacle 20 for storage of said aerosol propellant A for later use as a cooling agent.

Figure 21:
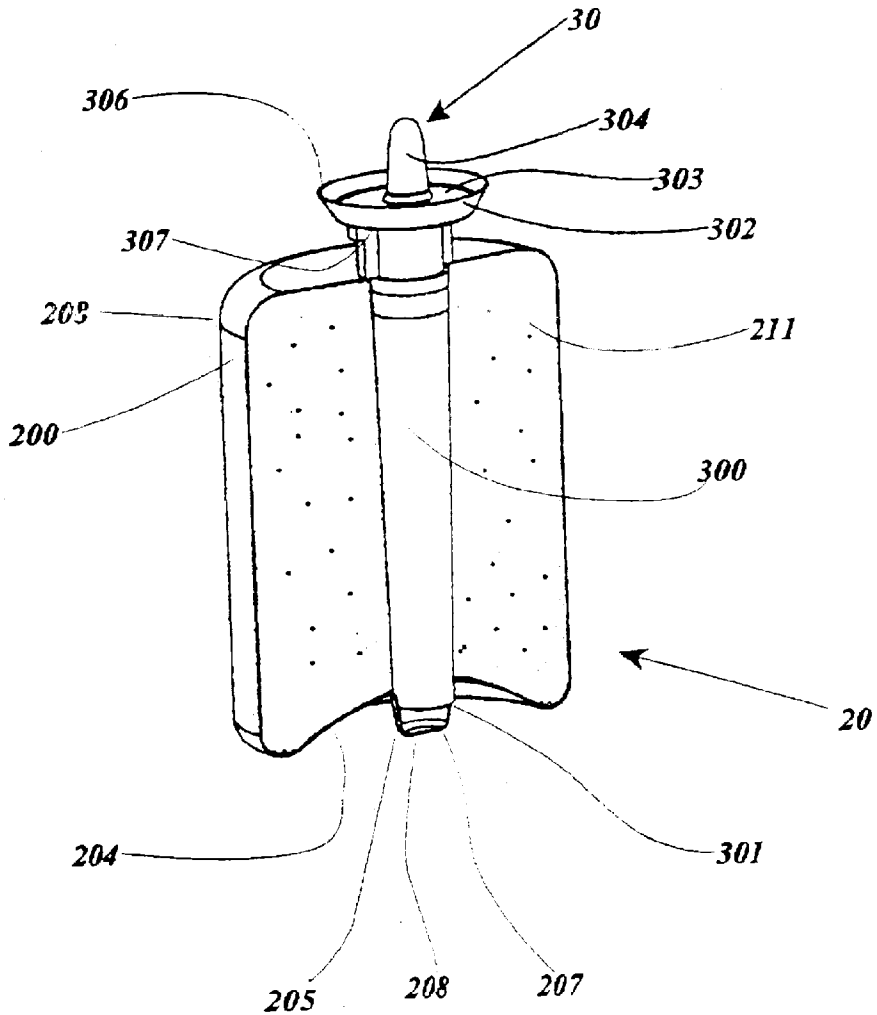
FIG. 21 shows a cut-away view of the aerosol propellant receptacle according to the second embodiment with the aerosol propellant matrix filling the aerosol propellant receptacle for assembly with the container and stem valve assembly.
Figure 22:
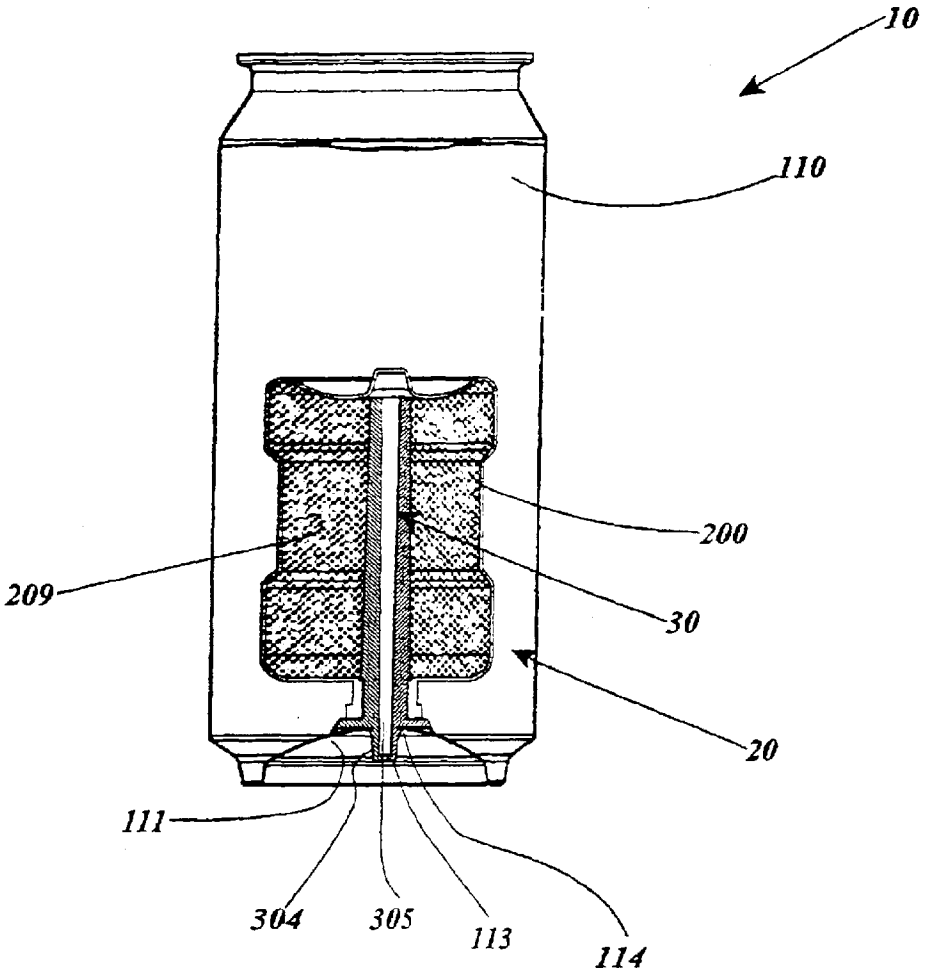
FIG. 22 shows a cut-away view of the aerosol propellant receptacle according to the second embodiment with the salt crystal matrix filling the aerosol propellant receptacle for assembly with the container and stem valve assembly, and the valve seat hole for communication of the container contents with the salt crystal.
Figure 23:
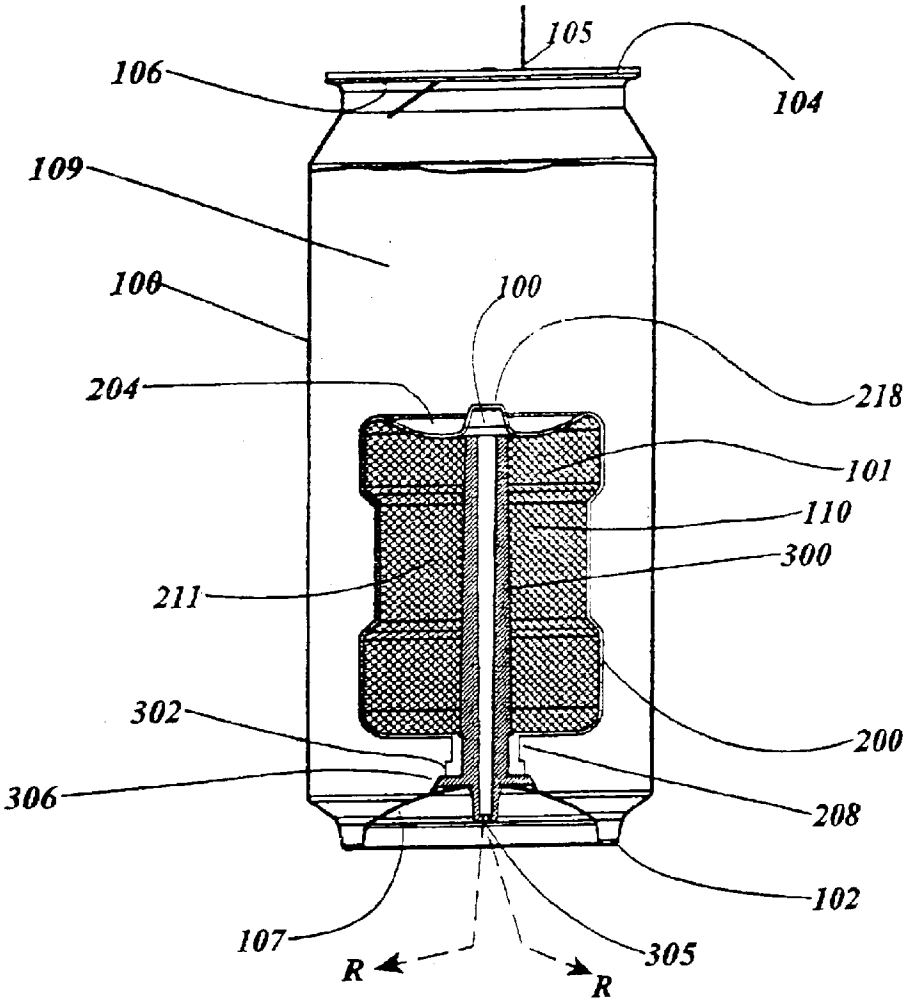
FIG. 23 shows a cut-away view of the aerosol propellant receptacle according to the second embodiment with the salt crystal matrix filling the aerosol propellant receptacle being saturated with water based container contents for achieving an endothermic reaction.
Figure 24:
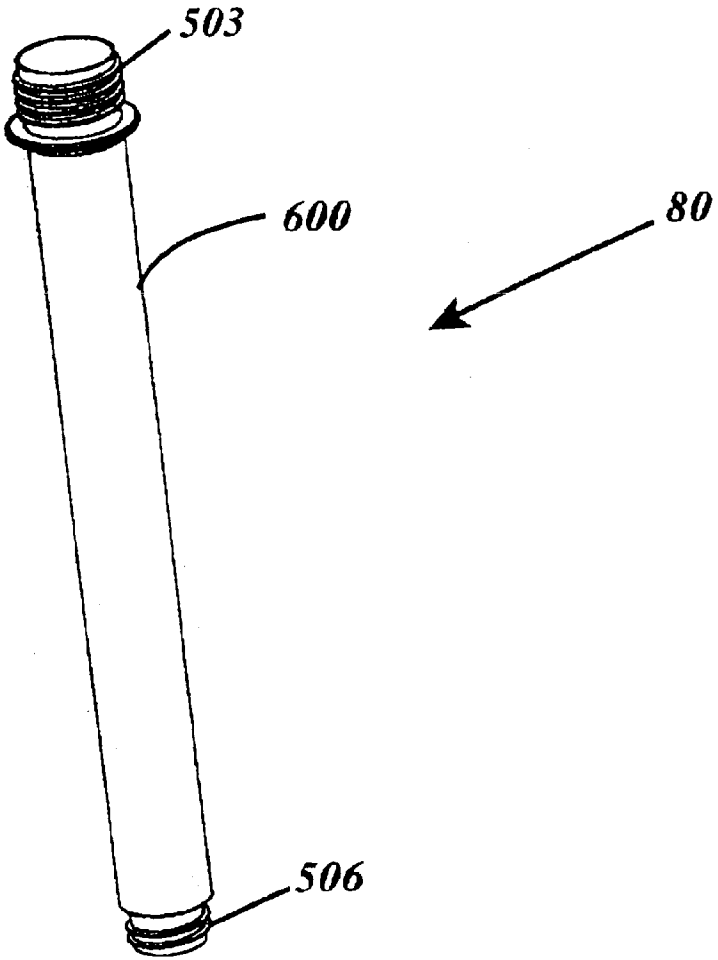
FIG. 24 shows a beverage bottle preform prior to forming the bottle and the aerosol propellant receptacle.
Figure 25:
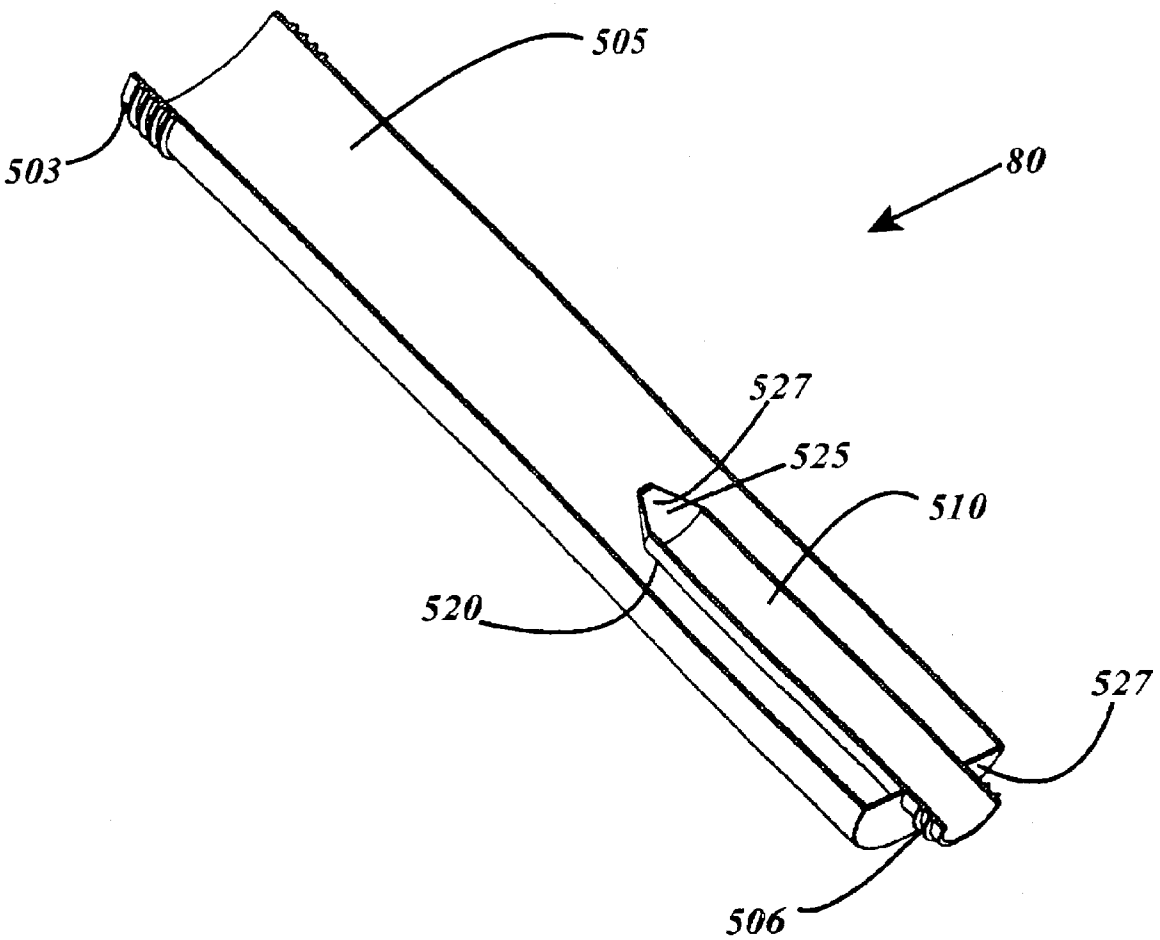
FIG. 25 shows a cross section of the bottle preform.
Figure 26:
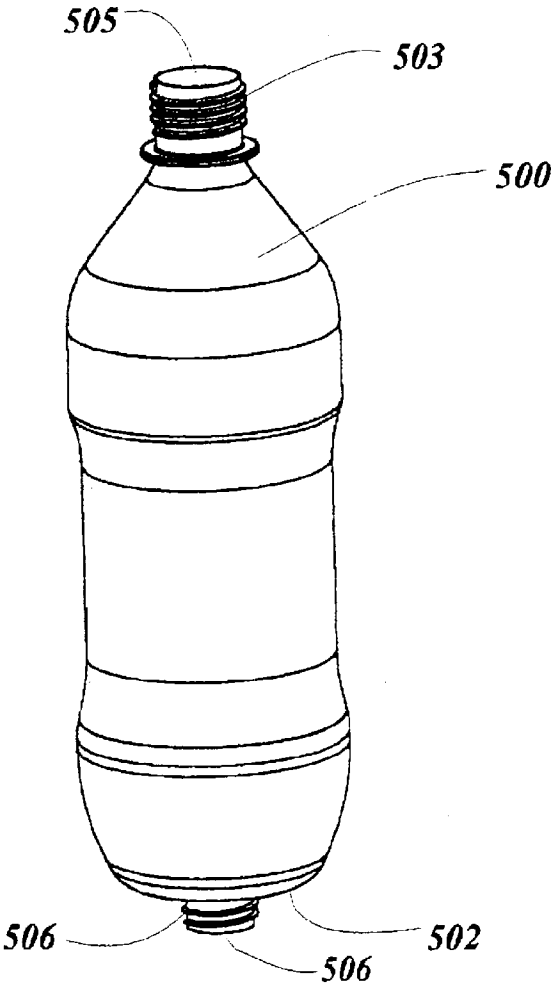
FIG. 26 shows the first stage of blow molding a bottle shape while the aerosol propellant receptacle is still not blown.
Figure 27:
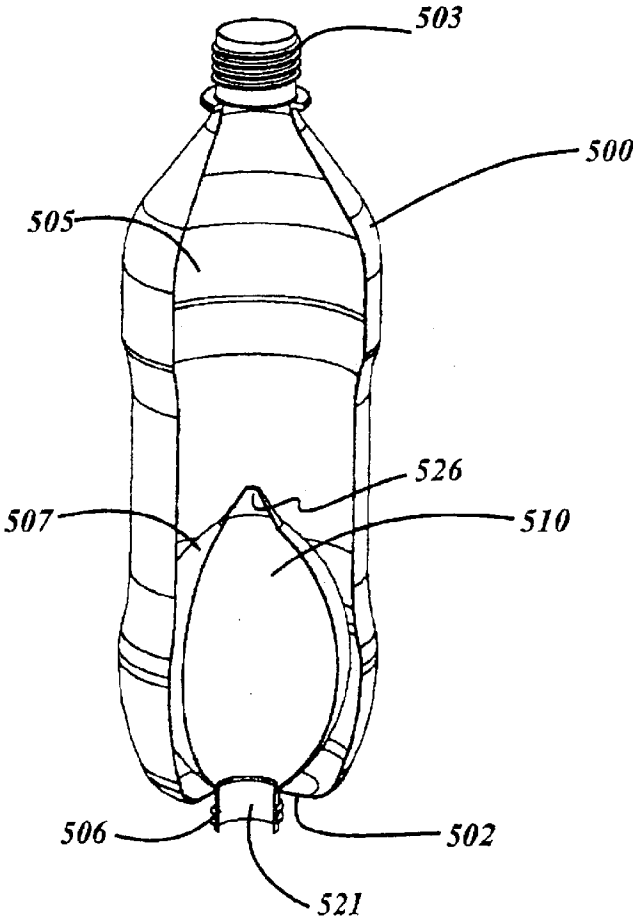
FIG. 27 shows the second stage of blow molding the aerosol propellant receptacle inside the bottle.
Figure 28:
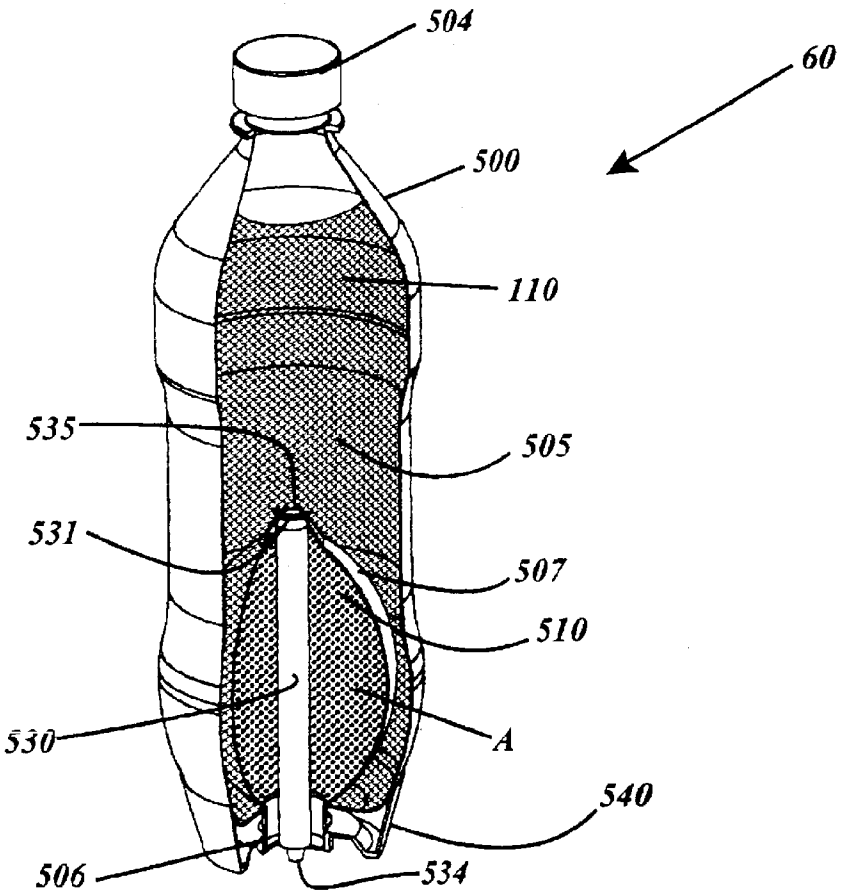
FIG. 28 shows a cut away view of the bottle and the stem valve assembly.
Figure 29:
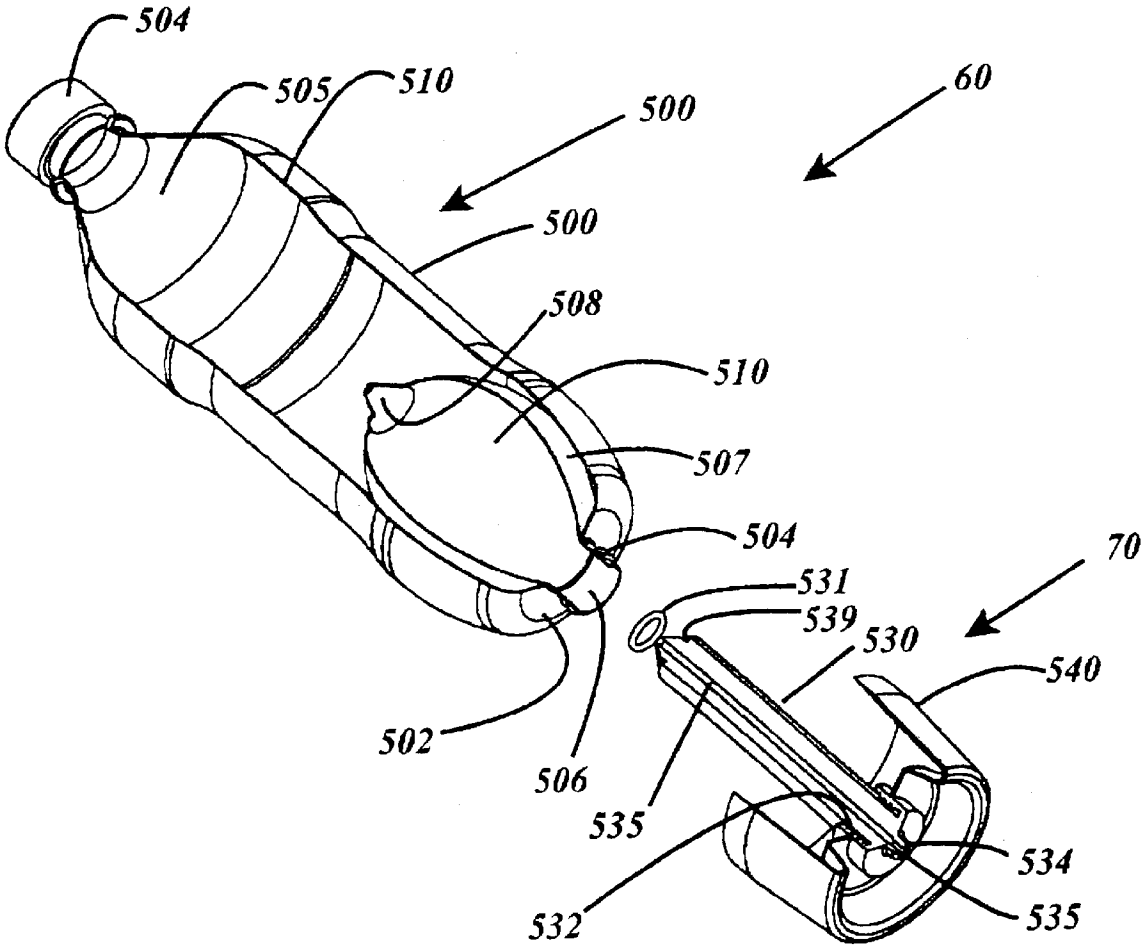
FIG. 29 shows an exploded view of the bottle and valve assembly in the second preferred embodiment of the invention.

In yet a second embodiment of the invention, a water soluble salt 211 is used as a aerosol propellant medium A when mixed with water. In this embodiment, the aerosol propellant receptacle 20 has a valve seat hole 218 through the center of the aerosol propellant receptacle valve seat recess 207. This configuration is shown in FIG. 21 and FIG. 22. This valve seat hole 218 allows fluid communication between the inside of the aerosol propellant receptacle 20 and the container contents 110 which generally contains water as part of its recipe, when the pressure inside the aerosol propellant receptacle 20 is greater than the container contents 110 pressure. When the apparatus is assembled and the valve stem 30 bottom edge 301 mates with valve seat recess 207, no fluid communication exists between the inside of aerosol propellant receptacle 20 and the atmosphere, or the inside of the aerosol propellant receptacle 20 and the container contents 110. In this embodiment, valve seat recess 207 is made to be initially tightly seated on sealing cone 301 to prevent any fluid container contents 110 from entering the aerosol propellant receptacle through the valve seat hole 218. This is achieved by simply pulling a vacuum through valve stem hole 305. Since this causes the inside of the aerosol propellant receptacle to have a negative pressure relative to atmosphere during the container contents filling process, a blast of carbonation pressure further seals the aerosol propellant receptacle valve seat recess 207 to the sealing cone 301 and this seal is maintained throughout and after the filling of the container contents 110 and during storage. The container contents pressure $P_B$ pressure difference with the inside of the aerosol propellant receptacle 20 will seal off the aerosol propellant receptacle valve seat hole 218 so that no container contents 110 can enter into the aerosol propellant receptacle 20.

During the manufacturing process, the aerosol propellant receptacle 20 is first filled with a water soluble salt 211 such as sodium chlorate which has a heat of solvation of ΔH=+21.72 Kilo joule per mole. Stem valve 30 is assembled with the aerosol propellant receptacle 20 as in the previous embodiment. The general shape and sizes of the aerosol propellant receptacle and valve stem is the same as in the previous embodiment. Thus, when the aerosol propellant receptacle and stem valve assembly 50 is attached to container 100 as in the previous embodiment, and the container contents 110 are sealed inside container 100, the container contents 110 pressure $P_B$ increases and compresses the aerosol propellant receptacle bottom wall 204 inwardly and forces the aerosol propellant receptacle bottom 204 wall to bow inward into aerosol propellant receptacle 20. This forces the valve seat recess 207 to forcibly mate with sealing cone 301 and seal off valve seat hole 218. Since there is no internal aerosol propellant in the aerosol propellant receptacle 20, when container 100 is sealed, the container contents pressure $P_B$ start to slowly permeate through the aerosol propellant receptacle 20 walls to mix with the salt crystals 211 and equilibrate inside of aerosol propellant receptacle 20 with the container contents pressure.

After equilibration, the valve seat will remain closed by design, since the valve stem 30 is made slightly longer and to snugly mate with valve seat recess 207 by a mechanical force. Thus, the inside surface of valve seat recess 207 and sealing cone 301 will stay forcibly mated and seal off the aerosol propellant receptacle valve seat hole 218 so that no container contents 110 can enter into the aerosol propellant receptacle 20 through aerosol propellant receptacle valve seat hole 218. Aerosol propellant receptacle valve seat hole 218 is about $1/8^{th}$ of an inch in diameter. After storage, and when the container contents are desired for consumption, the consumer simply opens the container lid opening means 105 to consume the container contents 110. The product pressure $P_B$ falls to atmospheric pressure, and the carbonation gas trapped under pressure by permeation inside the aerosol propellant receptacle 20 causes the aerosol propellant receptacle 20 walls to expand irreversibly, and aerosol propellant receptacle valve seat recess 207 is pushed away from the sealing cone 301. This expansion of the aerosol propellant receptacle valve seat 205 breaks the mating lock between the aerosol propellant receptacle valve seat recess 207 and the sealing cone 301. This allows some of the fluid body of container contents 110 to enter into the aerosol propellant receptacle 20 through aerosol propellant receptacle valve seat hole 218 and permeate the salt crystals 211. The reaction of the water content of the container contents 110 and the salt crystals 211 is endothermic. This results in the cooling of the product 211 by the endothermic reaction of salt crystals and water.

Referring to FIGS. 2 AND 24–29 scented self cooling beverage bottle apparatus 60 is disclosed. In the first of the preferred of several possible embodiments, the apparatus 10 includes a plastic bottle 500 containing contents 110 having a conventional unified bottom wall 502, and a terminating in an upper bottle threaded neck 503. A bottle threaded cap 504 is also provided for sealing off the bottle contents 110 inside the bottle 500. The bottom wall of the bottle 500 is unified with an internally projecting aerosol propellant receptacle 520 so that a contiguous beverage chamber 505 is formed between aerosol propellant receptacle 520 and the inside of the bottle 500, and the inside chamber 510 of the aerosol propellant receptacle 520 forms a receptacle for aerosol propellant mixtures A bottle 500 is made from a two part contiguous preform 60 that comprises two separate chambers 511 and chamber 512 fused together to form a concentric cylindrical beverage chamber 505 and an aerosol propellant chamber 510. Chamber 511 terminates in an open bottle threaded neck 503. Chamber 512 terminates in a open threaded sealing neck 506 and has a contiguous bottom that form a conical valve seat 526. Chamber 512 is essentially almost contained within chamber 511, except for the threaded sealing neck 506 which protrudes away from the chamber 511. The preform 60 is used to make the separate chambers that will hold the aerosol propellant A and the bottle contents 110.

To manufacture the apparatus, preform 80 is first heated and then blow molded through the bottle threaded neck 503 to expand chamber 511 into a mold that takes the desired shape of the bottle. Then while holding the shape of valve seat 526 through bottle threaded neck 503 with a mold support member that keeps the shape of the valve seat 526, chamber 512 is blown to form an aerosol propellant receptacle 520 with substantially paraboloid receptacle side walls 507. The walls may take on any particular shape that will conform to the pressure response characteristics of the plastic material used for the preform 80. The aerosol propellant receptacle 520 is thus substantially within the formed bottle 500 with its open threaded sealing neck 506 facing in a direction opposite to the bottle threaded neck 503.

The sizes of the bottle 500 and the aerosol propellant receptacle 520 may be varied to any suitable ratio, but a desirable ratio is about $$\frac{\text{propellant_chamber_volume}}{\text{Beverage_chamber_volume}} = \frac{1}{3}.$$

The aerosol propellant receptacle open threaded sealing neck 506 is preferably, but not necessarily, smaller than the bottle 500 threaded neck 503. The inside surface of valve seat 525 forms a valve seat recess 527, which is designed with an o-ring groove 539 to sealingly mate with the stem valve o-ring 531 of a substantially tubular stem valve 70, so that liquefied aerosol propellant A contained inside the paraboloid receptacle side walls 507 will not boil and escape from within the aerosol propellant receptacle 520 when the force generated by the pressure acting outside walls of the aerosol propellant receptacle 520 is greater than the pressure of the aerosol propellant A acting on the inside paraboloid receptacle side walls 507 of the aerosol propellant receptacle 520. Advantageously, the aerosol propellant receptacle 520 valve seat recess 527 will not form a seal with the o-ring 531 if the force due to pressure acting on outside of the aerosol propellant receptacle 520 walls is less than the force due to the liquified aerosol propellant A pressure acting on inside walls of the aerosol propellant receptacle 520. Conventional aerosol propellant storage systems simply store aerosol propellant in a phase equilibrium state so that the gas phase pressure is equal to the liquid phase pressure. However aerosol propellant receptacle 520 is designed to store the liquified aerosol propellant A in a phase locked condition, so that the gaseous phase is at a pressure slightly higher than that required to liquify the aerosol propellant mixture A at the temperature of the liquified aerosol propellant A. Advantageously, a higher packing fraction of liquified aerosol propellant A to aerosol propellant receptacle 520 volume can be achieved by this invention. The expected maximum packing fraction is recorded by empirical studies, is about 90%.

The apparatus 60 further comprises a stem valve 70 for mating with and forming a valve seal with aerosol propellant receptacle 520. The stem valve 70 is essentially a tubular valve that mates with aerosol propellant receptacle 520. Stem valve 70 comprises a short cylindrical tube 534 of a length of about ½ inches and diameter ⅜ inch which protrudes from the bottom surface 537 of a sealing threaded cap 532 and connects to a conical tube stem valve body 530 of a length of about 3 inches. Sealing threaded cap 532 is shaped like regular cylindrical locking cap to mate and thread snugly into threaded sealing neck 506. It is also configured in the shape of a cup 538 so that when it threads and seals unto threaded sealing neck 506 it forms a base 540 for bottle 500 to stand on A short small cylindrical stud 534 protrudes from the inside surface of the threaded sealing neck 506 in the opposite direction to the stem valve body 530. The approximate diameter of the stem valve stud 534 is ¼ inch, but it could be larger or smaller depending on the size of the beverage bottle 500. A small stem valve hole 535 passes through the entire length of the stem valve 70. The stem valve hole 535 could be made larger inside the stem valve body 530, for reasons of ease of manufacturing. The approximate diameter of the stem valve hole 535 is about 0.04 inches. Again all of the dimensions sited are examples of one embodiment of the invention.

In assembling the apparatus 50, a first step is affixing the stem valve 70 to the aerosol propellant receptacle 520 by passing the stem valve body 530 through the aerosol propellant receptacle neck protrusion opening 523, so that the stem valve cylindrical body 538 seals against the inside surface 528 of the aerosol propellant receptacle neck cylinder 521, and the bottom surface 537 of the stem valve sealing threaded cap sealingly mates to rim of the aerosol propellant receptacle threaded sealing neck 506. The stem valve 70 is designed to fit snugly and tightly into the aerosol propellant receptacle neck protrusion opening 523, so that a gas tight plug is formed around the aerosol propellant receptacle open neck 522. The stem valve 70 is made long enough so that when the bottom surface 537 of the sealing threaded cap 532 mates with the threads of threaded sealing neck 506, the conical stem valve body 538 also sealingly abuts the surface of the aerosol propellant receptacle valve seat 526. Thus, when the o-ring 531 abuts the valve seat 526, pressurized aerosol propellant gas A cannot escape through the stem valve hole 535, or through the aerosol propellant receptacle neck protrusion opening 523. Other methods of practicing the invention do not require that the o-ring 531 seal the surface of the aerosol propellant receptacle valve seat recess 527 when the sealing threaded cap 532 is fully seated on the aerosol propellant receptacle open neck 522. It is important that the o-ring 531 be close to or actually contact the inside of the aerosol propellant receptacle valve seat recess 527, so that if the pressure inside the aerosol propellant receptacle 520 is less than the pressure outside the aerosol propellant receptacle 520, the aerosol propellant receptacle bottom wall 524 is deflected inwardly to make contact between the inner surface of the aerosol propellant receptacle valve seat recess 527 and the 531 to form a gas tight seal that traps any liquefied or gaseous aerosol propellant inside the aerosol propellant receptacle 520 from escaping to the outside through the stem valve hole 535.

The manufacture of the apparatus is the same process as described earlier, where the aerosol propellant receptacle 520 is first filled with clean water 209. The stem valves 60 are then inserted and threaded into the aerosol propellant receptacle 520 through the aerosol propellant receptacle neck protrusion opening 523 to displace some water 209 and form a seal with the aerosol propellant receptacle open neck 522 and the inside surface of the aerosol propellant receptacle valve seat recess 207. Thus the water 209 is trapped inside the aerosol propellant receptacle 520 and cannot pass through the stem valve hole 535, or the aerosol propellant receptacle protrusion neck opening 523. The apparatus 60 is then transported to a beverage filling plant, where it is filled with contents 110 under carbonation pressure in the annular space formed by the boundary of aerosol propellant receptacle 520 inside of bottle 500. The sealing threaded cap 532 has a cup 536 that seals against the bottom surface of the bottle to form a stand.

During the beverage filling process, a filler head is sealed against the bottle threaded neck 503. Nitrogen or carbonation pressure is transmitted from the beverage filler head to the inside space 509 of the beverage bottle 500. This pressure is also fully transmitted to the aerosol propellant receptacle 520 outer walls. The pressure within the aerosol propellant receptacle 520 builds up and equilibrates with the pressure of the carbonation gas inside the beverage bottle 500. The pressure outside the aerosol propellant receptacle 520 causes the aerosol propellant receptacle bottom wall 524 to deform slightly, pushing against the trapped water 209 in the aerosol propellant receptacle 520 until the aerosol propellant receptacle valve seat recess inside surface 527 seals tightly against the o-ring 531 of the conical stem valve body 538. This stops any water 209 from escaping from the aerosol propellant receptacle 520. Since the aerosol propellant receptacle 520 is now filled with only water 209, and water 209 is essentially incompressible, minimal deformation of the aerosol propellant receptacle 520 walls occurs preventing any damage to the thin aerosol propellant receptacle 520 walls. The pressurization of the bottle 500 with carbon-dioxide gas is important when carbonated container contents 110 is being filled to ensure that the carbonation of the bottle contents 110 occurs during the filling process. The contents 110 itself is usually carbonated when it enters the bottle 500, where, because of the absorption of pressurized carbon/dioxide gas, it becomes highly carbonates A bottle threaded cap 504 is provided and is used to seal the bottle contents 110 inside the bottle 500. The rest of the process is exactly the same as those needed for charging and filling a metal container as described earlier.

While the above specifications reveal one of many embodiments of the present invention, it must be noted that several different representations of the invention could be constructed by one skilled in the art without limiting the generality of the invention.

I claim as my invention:

1. An aerosol propelled self-cooling container apparatus for retaining and cooling container contents in the form of a food item comprising:

a food container having a container first end and a container second end and having a wall; said container wall at said container first end terminating in an open container seaming rim and said container wall at said container second end having a container stem valve port, and having a container lid sealingly secured to said container seaming rim, said container lid having a container release means for releasing container contents;

A receptacle located within said container and having a receptacle first end adjacent to said container wall and a receptacle second end extending into said container, said receptacle having a receptacle wall including a receptacle stem valve port at said receptacle first end registering with said container stem valve port and including a flexible valve seat portion at said receptacle second end; said receptacle containing a liquified scented aerosol propellant mixture;

a stem valve with a substantially tubular stem valve body having a valve body first end and a valve body second end, and having a valve body passageway extending from said valve body first end passing sealingly through said receptacle stem valve port and passing sealingly through said container stem valve port, and said valve body second end sealingly bearing against said valve seat to close said valve passageway;

such that when receptacle pressure inside said receptacle is less than container pressure between said receptacle and said container, the pressure difference between the receptacle pressure and the container pressure produces a resultant pressure on said receptacle wall which sealingly basis said valve seat into sealing contact with said valve body second end, closing fluid communication between said receptacle and said valve body passage to retain the aerosol propellant within said receptacle, and such that when the receptacle pressure inside the receptacle is greater than container pressure between said receptacle and said container, the pressure difference between the receptacle pressure and the container pressure produces a resultant pressure on said receptacle wall which moves said valve seat away from the valve body second end, opening fluid communication between said receptacle and said valve body passageway to release the aerosol propellant from within said receptacle into the atmosphere surrounding said container, thereby cooling the container contents and at the same time releasing a desirable scent into the atmosphere surrounding said container.

2. The aerosol propelled self-cooling container of claim 1, wherein said valve body second end has an o-ring groove and an o-ring sealing attached to said o-ring grove.

3. The aerosol propelled self-cooling container of claim 1, wherein said aerosol propellant is a mixture of hydrocarbons and flame retardants.

4. An aerosol propelled self-cooling plastic bottle container apparatus for retaining and cooling plastic bottle container contents in the form of a food item comprising:

a plastic bottle container having a plastic bottle container first end and a plastic bottle container second end and having a plastic bottle container side wall; said plastic bottle container side wall at said plastic bottle container first end terminating in an open plastic bottle plastic bottle container threaded neck and said plastic bottle container wall at said plastic bottle container second end having a plastic receptacle wall projecting therefrom into and within said plastic bottle container; said receptacle wall extending from said plastic bottle container second end into said plastic bottle container and having a receptacle firs end and a receptacle second end; said receptacle first end including a flexible valve seat portion; said receptacle wall also extending out from said plastic bottle container second end from without said plastic container bottle; said receptacle second end having an open receptacle cylindrical threaded wall forming a receptacle stem valve port and said receptacle containing a liquified scented aerosol propellant mixture;

a stem valve with a substantially tubular stem valve body having a valve body first end and a valve body second end, and having a valve body passageway extending throughout said valve body; said valve body passing sealingly through said receptacle stem valve port and said valve body second end sealingly bearing against said valve seat to close said valve body passageway; said valve body first end having a threaded flange cup portion for sealingly threading and securing said valve stem to said open receptacle cylindrical threaded; such that when receptacle pressure inside said receptacle is less than plastic bottle container pressure between said receptacle and said plastic bottle container, the pressure difference between the receptacle pressure and the plastic bottle container pressure produces a resultant pressure on said receptacle wail which sealingly basis said valve seat into sealing contact with said valve body second end, closing fluid communication between said receptacle and said valve body passage to retain the aerosol propellant within said receptacle, and such that when the receptacle pressure inside the receptacle is greater than plastic bottle container pressure between said receptacle and said plastic bottle container, the pressure difference between the receptacle pressure and the plastic bottle container pressure produces a resultant pressure on said receptacle wall which moves said valve seat away from the valve body second end, opening fluid communication between said receptacle and said valve body passageway to release the aerosol propellant from within said receptacle into the atmosphere surrounding said plastic bottle container, thereby cooling the plastic bottle container contents and at the same time releasing a desirable scent into the atmosphere surrounding said plastic bottle container.

5. A self cooling bottle apparatus for retaining and cooling bottle contents in the form of a food item, comprising:

a food containing bottle having a bottle first end and a bottle second end and having a bottle wall, said bottle wall at said bottle second end having a stem valve port surrounded by a second threaded neck;

said bottle wall at said first end having a first threaded neck and a cap for releasing bottle contents;

a receptacle located within said bottle and having a receptacle first end adjacent to said bottle wall and a receptacle second end extending into the bottle, said receptacle having a receptacle wall including a receptacle stem valve port at said receptacle first end registering with said bottle stem valve port and including a flexible valve seat portion at said receptacle second end, said receptacle containing a liquified propellant mixture;

a stem valve with a substantially tubular stem valve body having a valve body first end and having a valve body second end and having a valve body passageway extending from said valve body first end to said valve body second end, said valve body second end seatingly bearing against said valve seat with an intervening o-ring to close said valve body passageway; such that when receptacle pressure inside said receptacle is less than bottle pressure between said receptacle and said bottle the pressure difference between the receptacle pressure and the bottle pressure produces a resultant pressure on said receptacle wall which sealingly biases said valve seat into sealing contact with said valve body second end and said o-ring, closing fluid communication between said receptacle and said valve body passageway to retain the refrigerant within said receptacle, and such that when the receptacle pressure inside the receptacle is greater than the bottle pressure between the receptacle and the bottle the pressure difference between the receptacle pressure and the bottle pressure produces a resultant pressure on said receptacle wall which moves said valve seat away from the valve body second end and said o-ring, opening fluid communication between said receptacle and said valve body passageway to release the aerosol propellant refrigerant from within said receptacle into the atmosphere surrounding said body thereby cooling the bottle contents.

* * * * *